US010060127B2

(12) United States Patent
Miranda Camino et al.

(10) Patent No.: US 10,060,127 B2
(45) Date of Patent: Aug. 28, 2018

(54) PREFABRICATED WALL OF TILES OR PANELS

(71) Applicant: KING & MIRANDA DESIGN S.R.L., Milan (IT)

(72) Inventors: Santiago Miranda Camino, Milan (IT); Perry Allan King, Milan (IT)

(73) Assignee: KING & MIRANDA DESIGN S.R.L., Milan (IT)

( * ) Notice: Subject to any disclaimer, the term of this patent is extended or adjusted under 35 U.S.C. 154(b) by 0 days.

(21) Appl. No.: 15/527,990

(22) PCT Filed: Nov. 17, 2015

(86) PCT No.: PCT/EP2015/076844
§ 371 (c)(1),
(2) Date: May 18, 2017

(87) PCT Pub. No.: WO2016/079131
PCT Pub. Date: May 26, 2016

(65) Prior Publication Data

US 2017/0356185 A1 Dec. 14, 2017

(30) Foreign Application Priority Data

Nov. 18, 2014 (IT) ..... MI2014A001994
Apr. 10, 2015 (IT) ..... 102015000011458

(51) Int. Cl.
*E04B 2/74* (2006.01)
*E04F 13/08* (2006.01)

(52) U.S. Cl.
CPC ..... *E04B 2/7407* (2013.01); *E04F 13/0851* (2013.01); *E04B 2002/7466* (2013.01);
(Continued)

(58) Field of Classification Search
CPC ..... E04B 2/7407; E04B 2002/7483; E04B 2002/7487; E04B 2002/7466; E04B 2/7448; E04F 13/0851
See application file for complete search history.

(56) References Cited

U.S. PATENT DOCUMENTS 4,022,461 A * 5/1977 Harris ..... A63J 1/02 472/75
4,535,577 A * 8/1985 Tenser ..... E04B 2/7429 174/495

(Continued)

FOREIGN PATENT DOCUMENTS

CA 2 602 765 A1 10/2006
EP 0 582 292 A1 2/1994

(Continued)

OTHER PUBLICATIONS

International Search Report, dated Jan. 25, 2016 (3 pages).

*Primary Examiner* — Rodney Mintz
(74) *Attorney, Agent, or Firm* — Jacobson Holman, PLLC.

(57) ABSTRACT

A prefabricated wall (100) being modular is described, comprising at least one module (1) comprising at least one sheet layer (2) adapted to mount at least one panel (5) by means of fixing means (6) and a supporting frame (3), which supports said at least one module (1), said supporting frame (3) is a frame delimiting a through opening (30) which mounts said at least one sheet layer (2) which is a plate sheet comprising a multiplicity of through openings (20) and a multiplicity of through slots (25) adapted to be traversed by a fixing mean (6) up to an engagement position of said fixing mean (6) with said at least one sheet layer (2) in order to mount said at least one panel (5).

17 Claims, 24 Drawing Sheets

(52) U.S. Cl.
CPC ..... *E04B 2002/7483* (2013.01); *E04B 2002/7487* (2013.01)

(56) References Cited

U.S. PATENT DOCUMENTS

| | | | | | |
|---|---|---|---|---|---|
| 4,916,875 | A * | 4/1990 | Kashiwagi | E04F 13/0851 | 52/302.3 |
| D330,435 | S * | 10/1992 | Dukart | D25/138 | |
| 6,601,349 | B1 | 8/2003 | Corden | | |
| 6,857,248 | B2 * | 2/2005 | Ouellet | E04F 13/0862 | 249/141 |
| 6,955,204 | B1 * | 10/2005 | Gilbert | E04B 2/7431 | 160/135 |
| 9,227,764 | B2 * | 1/2016 | Martino | G08B 13/20 | |
| 9,477,142 | B1 * | 10/2016 | Baumgartner | A63J 1/02 | |
| 2001/0039774 | A1 | 11/2001 | Beirise et al. | | |
| 2002/0174622 | A1 * | 11/2002 | Ouellet | E04F 13/0862 | 52/745.06 |
| 2013/0326975 | A1 | 12/2013 | Stenseide | | |
| 2014/0212643 | A1 | 7/2014 | Ciuperca | | |
| 2014/0262901 | A1 | 9/2014 | Martino | | |
| 2016/0083964 | A1 * | 3/2016 | Martino | B65D 73/0014 | 52/489.1 |
| 2017/0045804 | A1 * | 2/2017 | Baumgartner | A63J 1/02 | |

FOREIGN PATENT DOCUMENTS

| | | | |
|---|---|---|---|
| WO | 87/01751 | A1 | 3/1987 |
| WO | 02/08851 | A2 | 1/2002 |

* cited by examiner

PREFABRICATED WALL OF TILES OR PANELS

BACKGROUND OF THE INVENTION

The present invention relates to a prefabricated wall of tiles or panels.

DESCRIPTION OF RELATED ART

Modular prefabricated walls for panels are found in the known prior art, such as for example US-2014/0212643-A1, which describes a modular prefabricated wall comprising at least one module consisting of a panel and a horizontal guide. A back side of the horizontal guide is mounted on a wall by means of plugs. The horizontal guide comprises a vertical portion adapted to act as a base for mounting a panel thereon by means of screws. Disadvantageously, the prefabricated wall is not very solid and there is a need to prepare a series of horizontal guides mounted on the wall at predetermined distances in order to mount a prefabricated wall of vertical panels.

EP-0582292-B2 describes a modular prefabricated wall comprising at least one module consisting of a panel and a horizontal guide. A back side of the panel mounts an element with a hook-shaped section adapted to be mounted straddling a vertical element of the horizontal guide which supports the panel. Disadvantageously, the prefabricated wall is not very solid and there is a need to hook a multiplicity of horizontal guides to the wall at predetermined distances therebetween in order to then mount the panels thereon. Each horizontal row of panels disadvantageously requires a horizontal guide in order to be mounted, thus making mounting the panels difficult and complicated. Disadvantageously, there is also a need to have a wall for supporting each horizontal guide.

US-2013/0326975-A1 describes a prefabricated wall comprising a corrugated sheet which mounts panels. The corrugated sheet has valley-shaped portions and wave crest-shaped portions. The valley-shaped portions are attached to the wall and the wave crest-shaped portions are adapted to act as a base to allow the panels to be fastened by means of fixing means. Disadvantageously, the corrugated sheet is not very solid and requires a wall in order to mount the panels.

CA-2602765 describes a prefabricated wall for plates. The prefabricated wall comprises at least one support frame consisting of a multiplicity of pairs of vertical bars and of pairs of horizontal bars mutually perpendicular crossed to form a grid. Cross points are delimited by the pairs of vertical and horizontal bars. Fasteners screw the plates from the outside to the cross points between the pairs of vertical and horizontal bars. Disadvantageously, the plates are fastened from the outside and the structure and the plates need to have through holes for allowing the securing elements to pass. Furthermore, there is a need to include elements for securing the reciprocal distance between the bars to keep them at the exact distance therebetween, so that they can mount the plates, thus disadvantageously making mounting the support frame complicated, not very solid and not long-lasting.

U.S. Pat. No. 6,601,349-B1 describes a prefabricated structure of a wall, said structure is modular and comprises a multiplicity of modules. A multiplicity of modules are suitable for mounting one panel by means of a multiplicity of hooks of said panel. Said module consists of two vertical uprights of U-shape section which supports two horizontal spacer bars of U-shape section, wherein said two uprights and said two horizontal spacer bars are disposed to form a frame delimiting a through opening. Said panel comprises a multiplicity of through openings and said multiplicity of hooks. Said uprights of said at least one module comprises through slots but said through slots are not suitable for being traversed by said hooks of said at least one panel. Said uprights comprise a multiplicity of transversal lugs suitable for engage the hooks of the panel to mount said panel to the uprights.

US-2014/0262901-A1 describes a supporting panel suitable for mounting at least one panel by means of a multiplicity of hooks of the panel. Said supporting panel is mounted to a vertical upright by means of two lugs of the supporting panel which form a guide track. Said supporting panel is not a plate sheet, but a thick panel comprising a multiplicity of through slots, each one through slot of said multiplicity of through slots is suitable for being traversed by a hook of a multiplicity of hooks of the panel to mount said panel to the supporting panel. Disadvantageously the supporting panel is weighty and the vertical upright have to be solid and weighty too to support the supporting panel.

It is the object of the present invention to provide a prefabricated wall being modular, solid, lightweight, long-lasting and self-supporting, which is easy to be assembled, mounted, and which can be seen through.

According to the invention, such an object is achieved by a prefabricated wall being modular according to claim 1.

BRIEF DESCRIPTION OF THE DRAWINGS

These and other features of the present invention will become more apparent from the following detailed description of a practical embodiment thereof, shown by way of non-limiting example in the accompanying drawings, in which.

DETAILED DESCRIPTION OF THE INVENTION

With reference to the above-listed drawings, a prefabricated wall 100 of tiles 5 is noted, comprising at least one self-supporting module 1.

Figure 1:
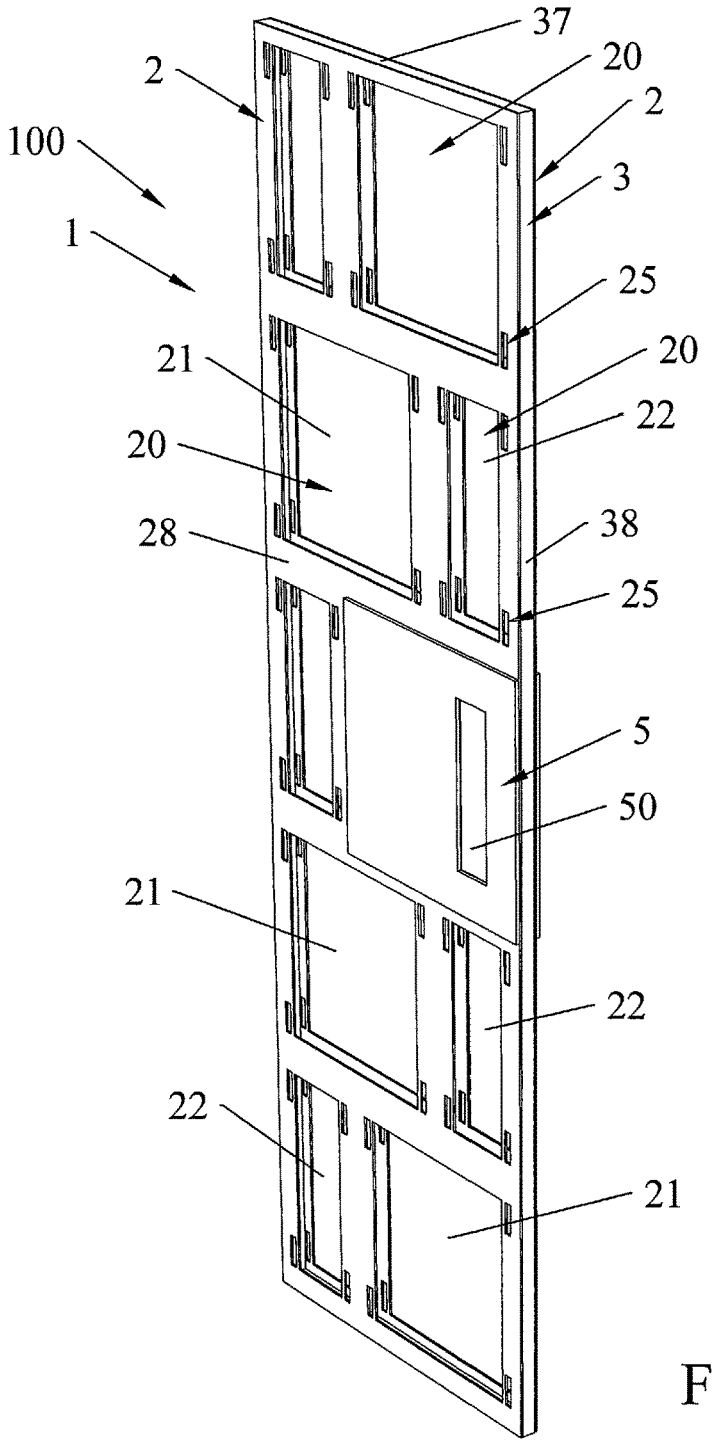
FIG. 1 shows a perspective view of module of a prefabricated wall.
Figure 2:
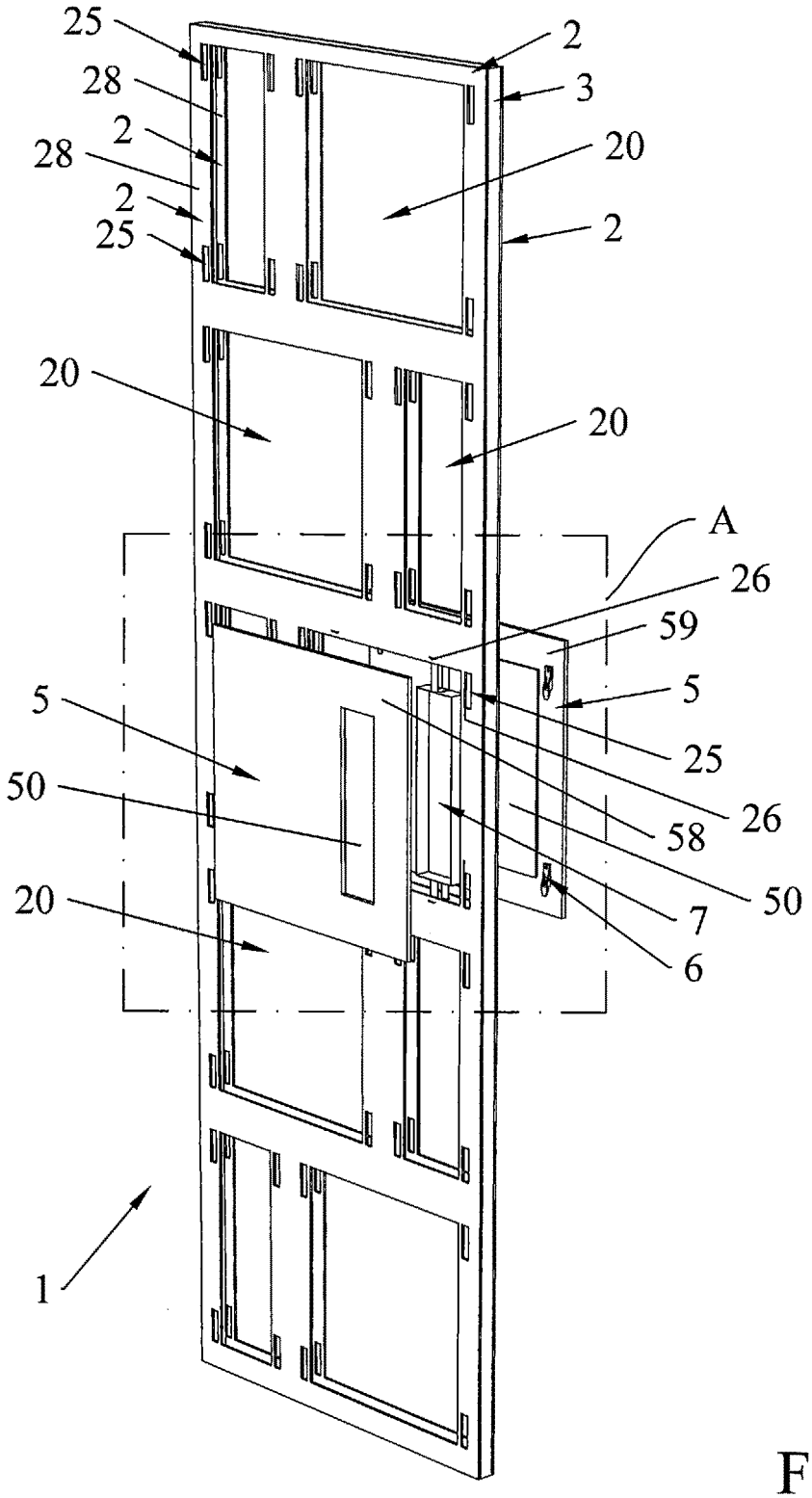
FIG. 2 shows an exploded view of FIG. 1.
Figure 3:
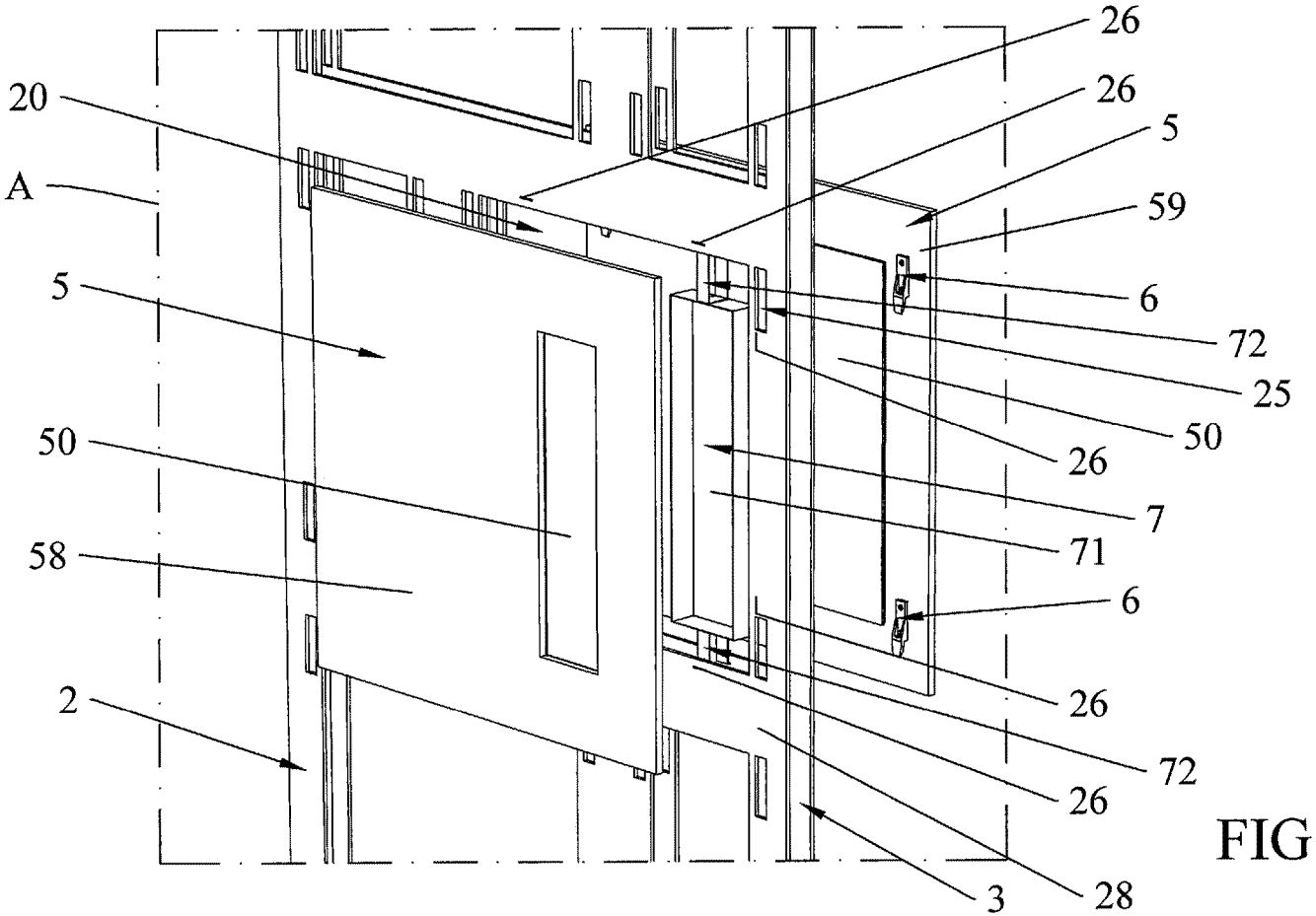
FIG. 3 shows an enlargement A of FIG. 2.
Figure 4:
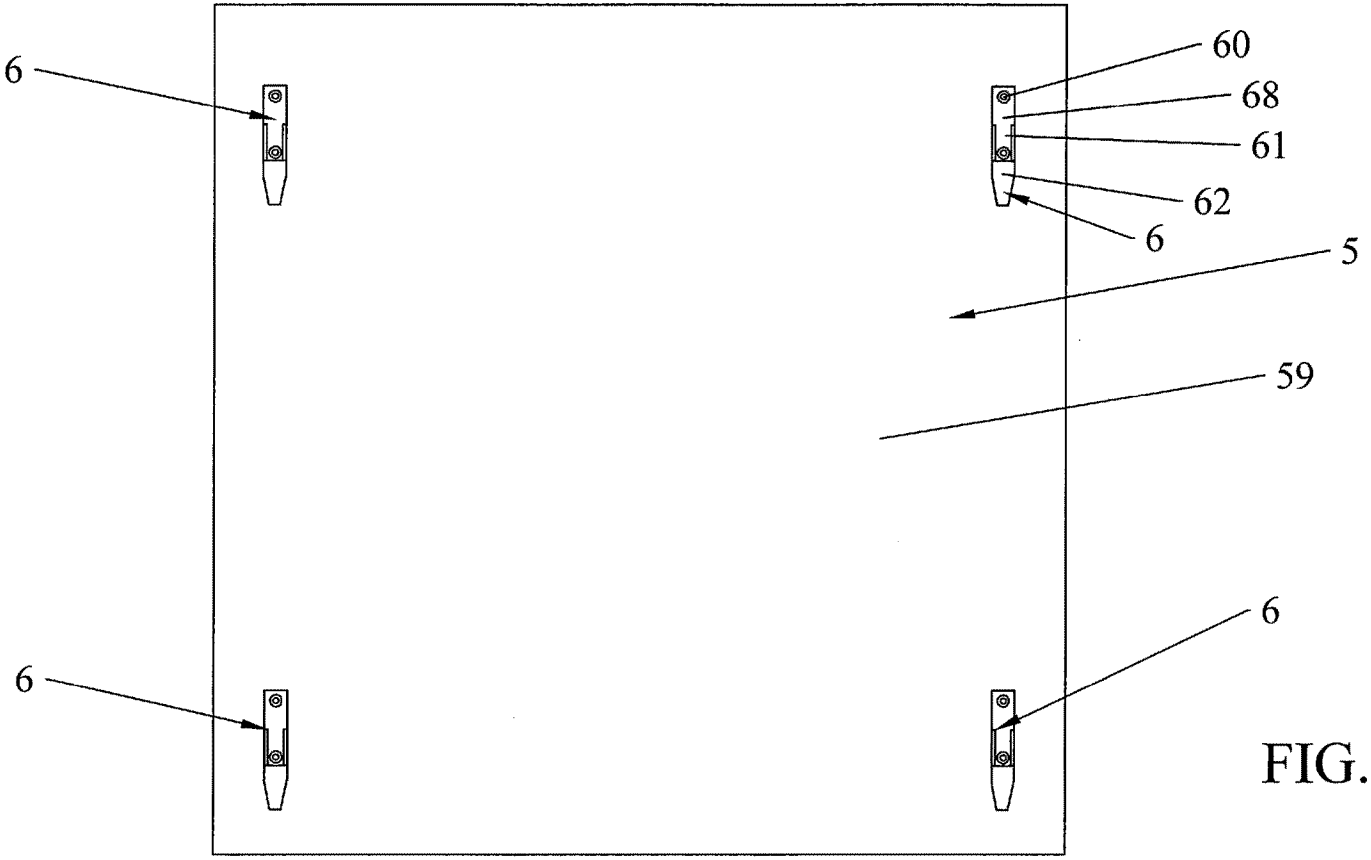
FIG. 4 shows a front view of a back side of a fixing means mounting tile.

In particular, FIG. 1 shows a module 1 of the prefabricated wall 100. In order to construct a larger prefabricated wall 100, a multiplicity of said modules 1 are placed both side by side along a larger side and side by side along a smaller side of said module 1.

Module 1 comprises at least one sheet layer 2 for mounting a multiplicity of tiles 5, and a supporting frame 3 which mounts said at least one sheet layer 2 on at least one frontal side 31. Another sheet layer 2 may also be mounted on a back side 32 of said supporting frame. 3, as particularly shown in FIGS. 1 and 9.

The supporting frame 3 is advantageously self-supporting and serves the purpose of wholly supporting the module 1 of the prefabricated wall 100. The supporting frame 3 comprises four parallelepiped-shaped bars 35-38 disposed to form a rigid, solid square frame, said frame has the same dimensions as module 1. Said four bars 35-38 delimit a through opening 30 having the same width as the supporting frame 3. Said one through opening 30 is just one in order to allow the supporting frame 3 not to limit the passage of light and make module 1 lightweight advantageously. A lower bar 35 serves as a base for module 1 and is adapted to rest on the ground or above another module 1 of the prefabricated wall 100. Two side bars 36, 38 rise vertically upward parallel to each other from two ends of the lower bar 35. Above an upper end of the two side bars 36, 38 there is provided an upper bar 37, which is parallel to the lower bar 35. The side bars 36, 38 are perpendicular both to the lower bar 35 and to the upper bar 37. The side bars 36, 38 are the larger sides of module 1, while the lower bar 35 and the upper bar 37 are the smaller sides of module 1. The supporting frame 3 is made of solid, sturdy materials to allow the structure of the square frame of the supporting frame 3 to be rigid enough. The frontal side 31 of the supporting frame 3 mounts sheet layer 2 through securing means such as glue, screws, nails or plugs. The back side 32 of the supporting frame 3 mounts another sheet layer 2. The frontal side 31 of the supporting frame 3 is defined by the frontal sides of the bars 35-38, while the back side 32 is defined by the back sides of the bars 35-38.

Figure 9:
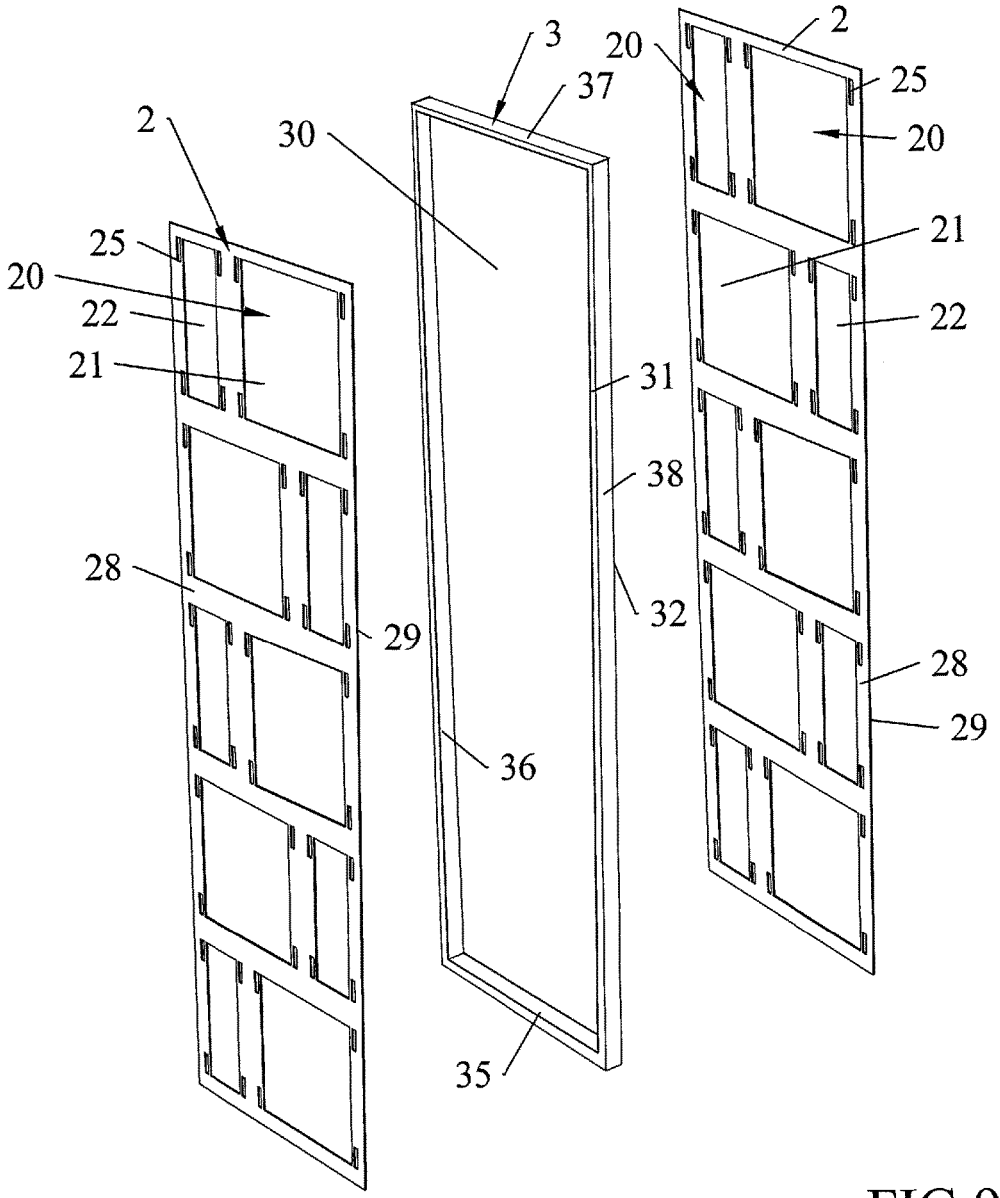
FIG. 9 shows a perspective view of an exploded view of the module of the prefabricated wall in FIG. 1.
Figure 10:
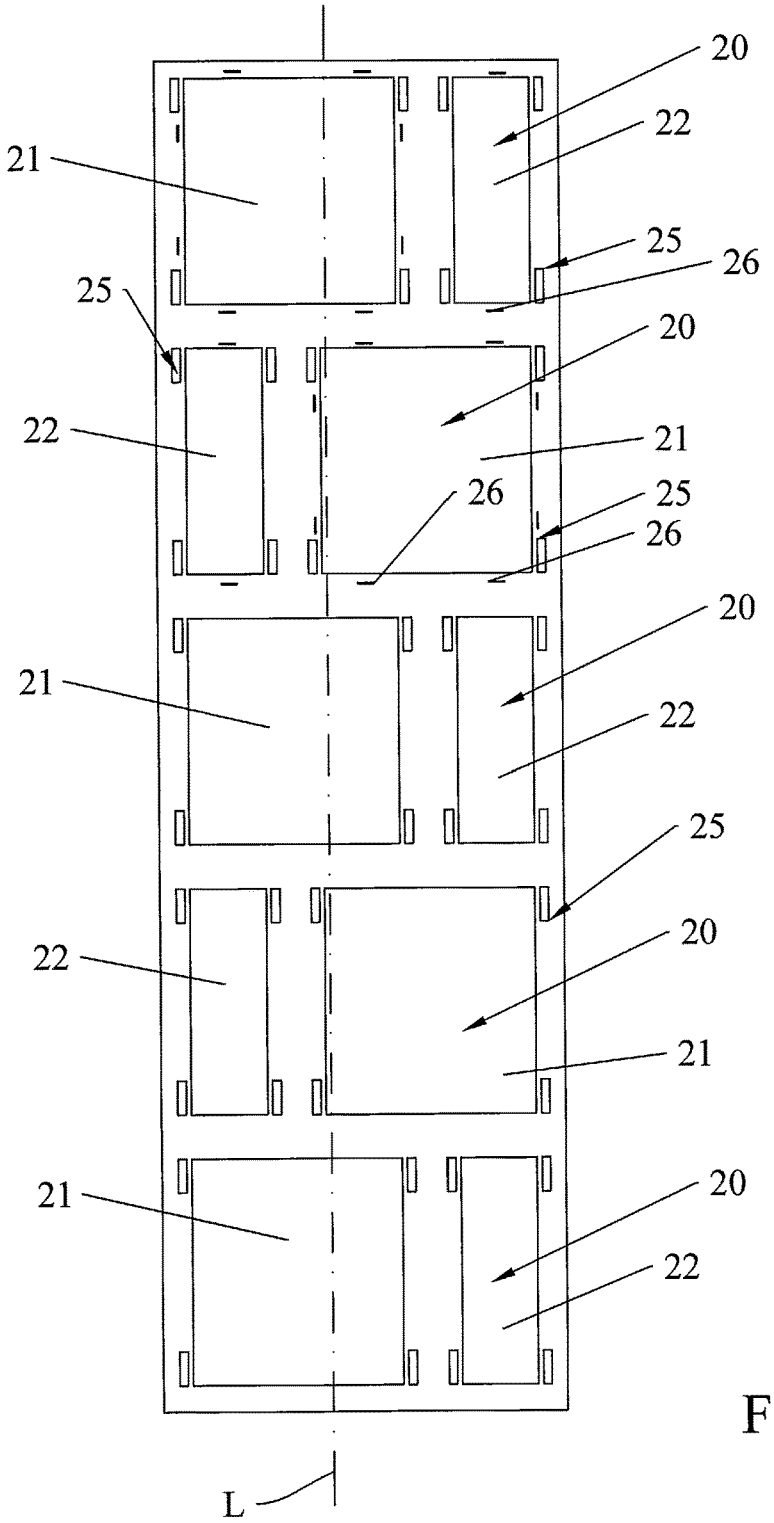
FIG. 10 shows a front view of a sheet layer of the prefabricated wall.

As particularly shown in FIG. 10, sheet layer 2 is a plate sheet of the same dimensions and shape as the supporting frame 3 on which it is mounted. As shown in FIG. 9, sheet layer 2 comprises a frontal side 28 and a back side 29, the back side 29 of sheet layer 2 is mounted against the frontal side 31 of the supporting frame 3. The other sheet layer 2 mounts the frontal side 28 of sheet layer 2 against the back side 32 of the supporting frame 3.

As particularly shown in FIG. 10, sheet layer 2 is advantageously lightweight, indeed the sheet of sheet layer 2 is perforated in a multiplicity of through openings 20 adapted to lighten the structure of sheet layer 2 and to allow light to pass therethrough and for it to be seen through.

As particularly shown in FIGS. 1 and 9, two sheet layers 2 are mounted with the supporting frame 3 so that the through openings 20 of the sheet layer 2 mounted at the front correspond to the through openings 20 of the sheet layer 2 mounted at the back, so that light can pass through module 1 and said module 1 can be seen through.

Said multiplicity of through openings 20 comprises through openings of different shape: square through openings 21 and rectangular through openings 22. A square through opening 21 and a rectangular through opening 22 have vertical sides 206, 208 of the same dimensions. Two rectangular through openings 22 placed horizontally side by side on the same geometrical plane where sheet layer 2 lies, advantageously have the same horizontal dimensions as the horizontal sides 205, 207 of the square through opening 21 so as to mount a tile 5. The dimensions of the sides 205-208 of the through openings 20 are selected to facilitate the operation of mounting the tiles 5 and to allow several modules 1 to be placed side by side, close to one another, to form a modular prefabricated wall 100.

As particularly shown in FIG. 10, sheet layer 2 includes a multiplicity of through openings 20 disposed in an ordered series of horizontal rows which follow sheet layer 2 from top downward, thus following a vertical axis L. For example, five horizontal rows of through openings 20 are noted in FIG. 10. All horizontal rows comprise two differently shaped through openings 20: one of said square through openings 21 and one of said rectangular through openings 22. The order of the square 21 and of the rectangular 22 through openings in adjacent horizontal rows is inverted with respect to the vertical axis L, so that if a first top horizontal row comprises, in a first order from left to right, the square through opening 21 and the rectangular through opening 22, a second horizontal row adjacent to the first horizontal row, disposed below the first horizontal row along the vertical axis L for example, has an adjacent horizontal row comprising, in a second order from left to right, the rectangular through opening 22 and the square through opening 21.

The square through opening 21 and the rectangular through opening 22 placed horizontally side by side on a geometrical plane where said at least one sheet layer 2 lies, form a pair of through openings 21, 22 disposed in an ordered horizontal row of through openings 20, said ordered horizontal rows of through openings 20 are in sequence along a vertical axis L, from top downward. A horizontal row adjacent to another horizontal row has an inverted order of the pairs of through openings 21, 22. Thereby, the operation of modularly mounting the tiles 5 on said modules 1 is facilitated, as shown in FIG. 11.

Figure 11:
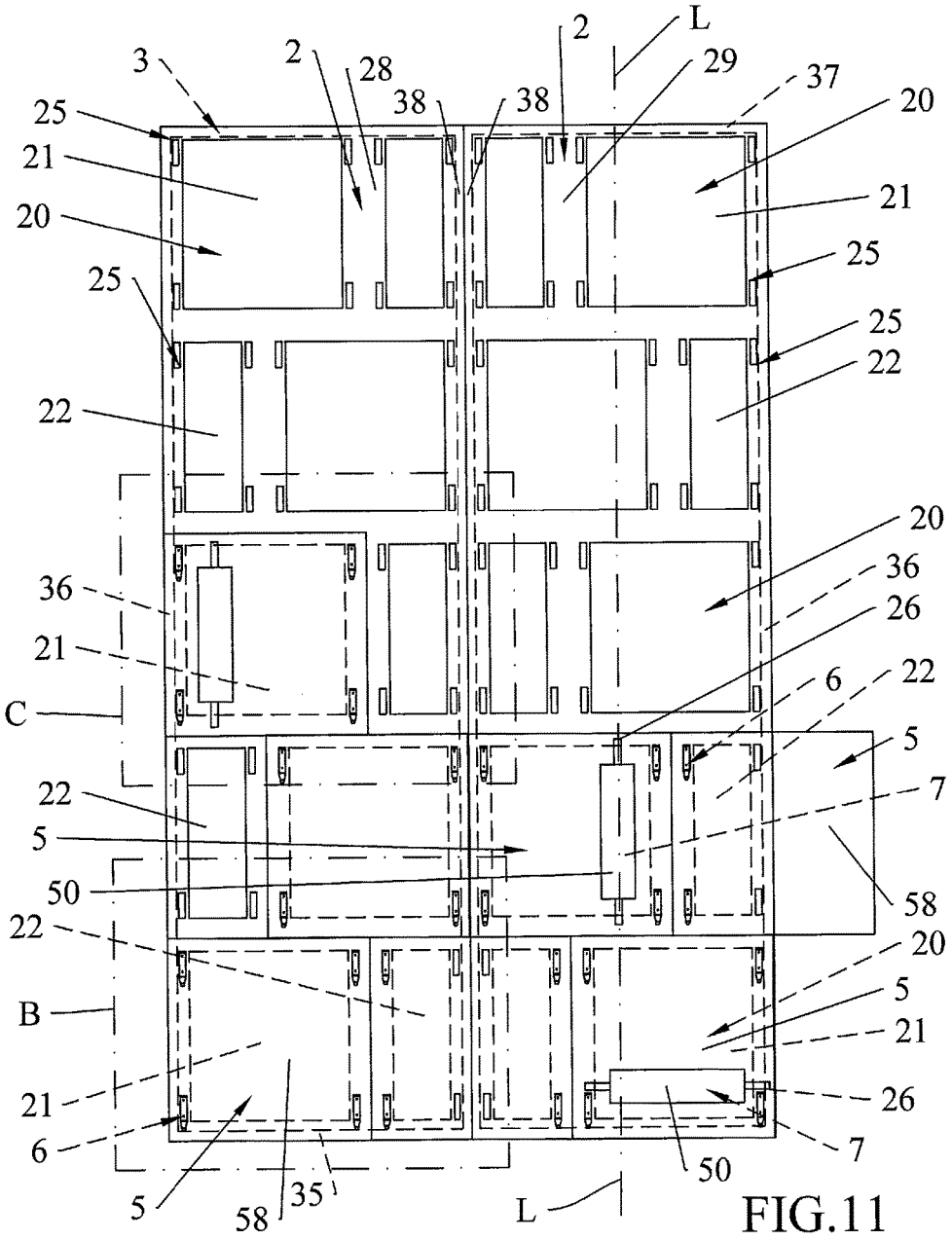
FIG. 11 shows a front view of two prefabricated wall modules mounted side by side.

When two modules 1 are placed horizontally side by side on the same geometrical plane, as shown in FIG. 11, a second sheet layer 2 horizontally adjacent to a first sheet layer 2 is rotated by 180° around the vertical axis L, so that the arrangement of the two sheet layers 2 side by side, seen from the front, is that the first sheet layer 2 has the frontal side 28 facing the observer and the second sheet layer 2 has the back side 29 facing the observer in the same direction.

Furthermore, in said arrangement of the two sheet layers 2, considering any horizontal row of said through openings 20, beside one of said square through holes 21 of the first sheet layer 2 there is also another square through hole of said square through holes 21 of the second sheet layer 2, and beside one of said rectangular through holes 22 of the first sheet layer 2 there is another rectangular through hole of said rectangular through holes 22 of the second sheet layer 22, so as to further facilitate the operation of modularly mounting the prefabricated wall 100, thus making mounting the tiles 5 with no spaces between one tile 5 and the other tile 5 simple and fast.

As particularly shown in FIG. 10, sheet layer 2 comprises a multiplicity of through slots 25 disposed around the through openings 20.

Each through slot 25 of said through slots 25 is rectangular in shape. Larger sides 256, 258 of the through slot 25 are oriented parallel to the vertical bars 36, 38 of the supporting frame 3, while a smaller side 255 and a larger side 257 of the through slot 25 are oriented parallel to the lower bar 35 and to the upper bar 37 of the supporting frame 3.

Figure 12:
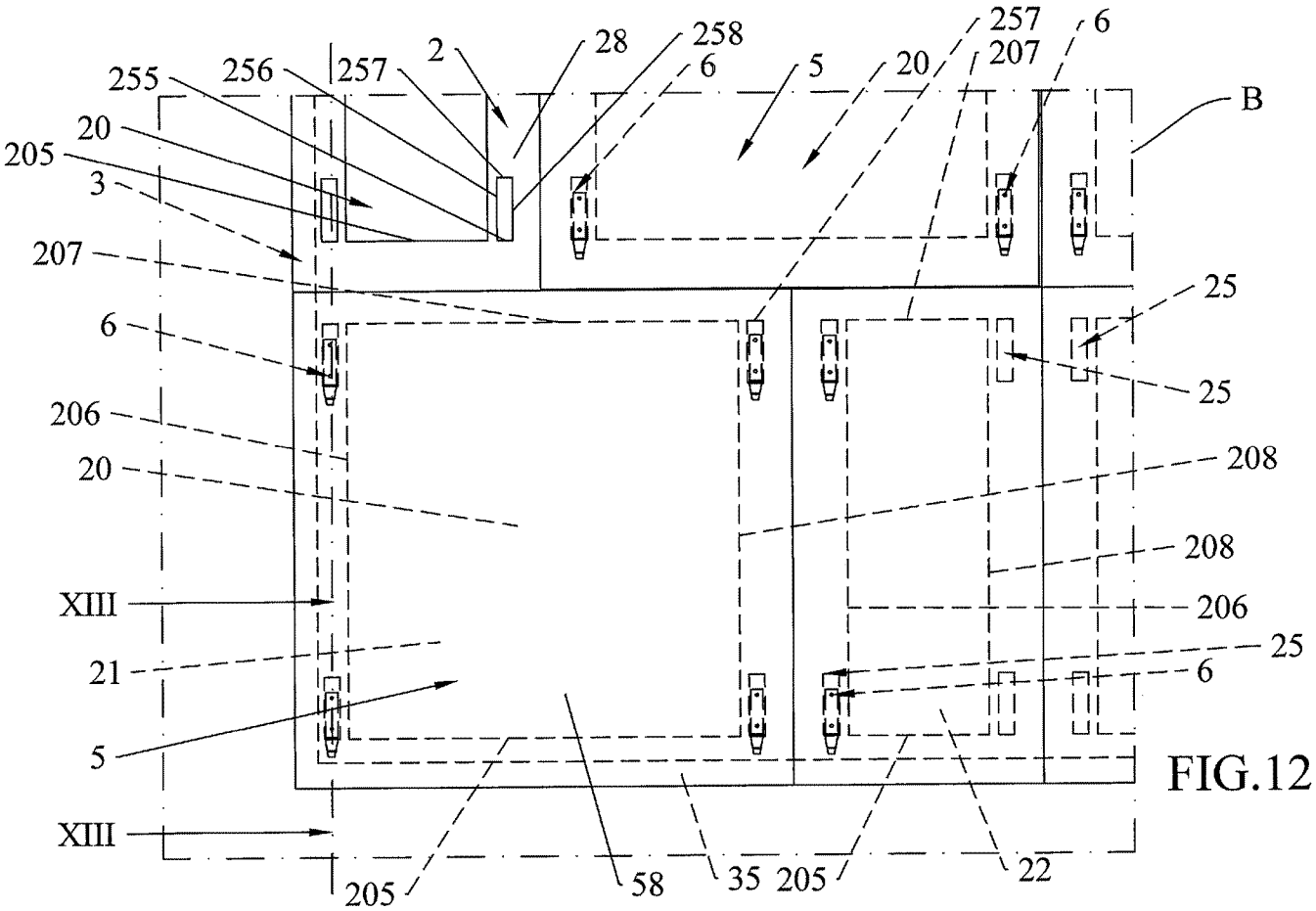
FIG. 12 shows an enlargement B of FIG. 11.

Four through slots 25 disposed close to four angles of the through openings 20 are provided around each of said through openings 20. Considering in particular FIG. 12, a pair of through slots 25 is disposed close to two upper angles of the through opening 20 so that the upper horizontal side 257 of the through slot 25 is positioned at the same height as the upper horizontal side 207 of the through opening 20. A pair of through slots 25 is disposed close to two lower angles of the through opening 20 so that the lower horizontal side 255 of the through slot 25 is positioned at the same height as the lower horizontal side 205 of the through opening 20. Said through slots 25 have dimensions of sides 255-258 advantageously adapted to be traversed by fixing means 6 mounted on a hidden side 59 of tile 5.

As particularly shown in FIGS. 1-4, said tiles 5 have a visible side 58 and said hidden side 59. Said tiles 5 are mounted by means of said fixing means 6, which are mounted on the hidden side 59 of tile 5. There are four of said fixing means 6, and they are disposed close to four angles of tile 5.

As particularly shown in FIGS. 11-14, said four fixing means 6 penetrate through four respective through slots 25 disposed at the four angles of the through openings 20. The through slots 25 have sufficient dimensions to be traversed by the fixing means 6 so that the fixing means 6 remain integrally in the through slots 25 of sheet layer 2 in as integral a manner as possible.

The spatial arrangement of the fixing means 6 on the hidden side 59 of tile 5 copies the spatial arrangement of the through slots 25 around one of the through openings 20 of sheet layer 2 so that the spatial arrangement of the fixing means 6 corresponds to the spatial arrangement of the through slots 25.

As shown in FIGS. 5-8, a fixing mean 6 comprises a first portion 61 and a second portion 62.

Figure 13:
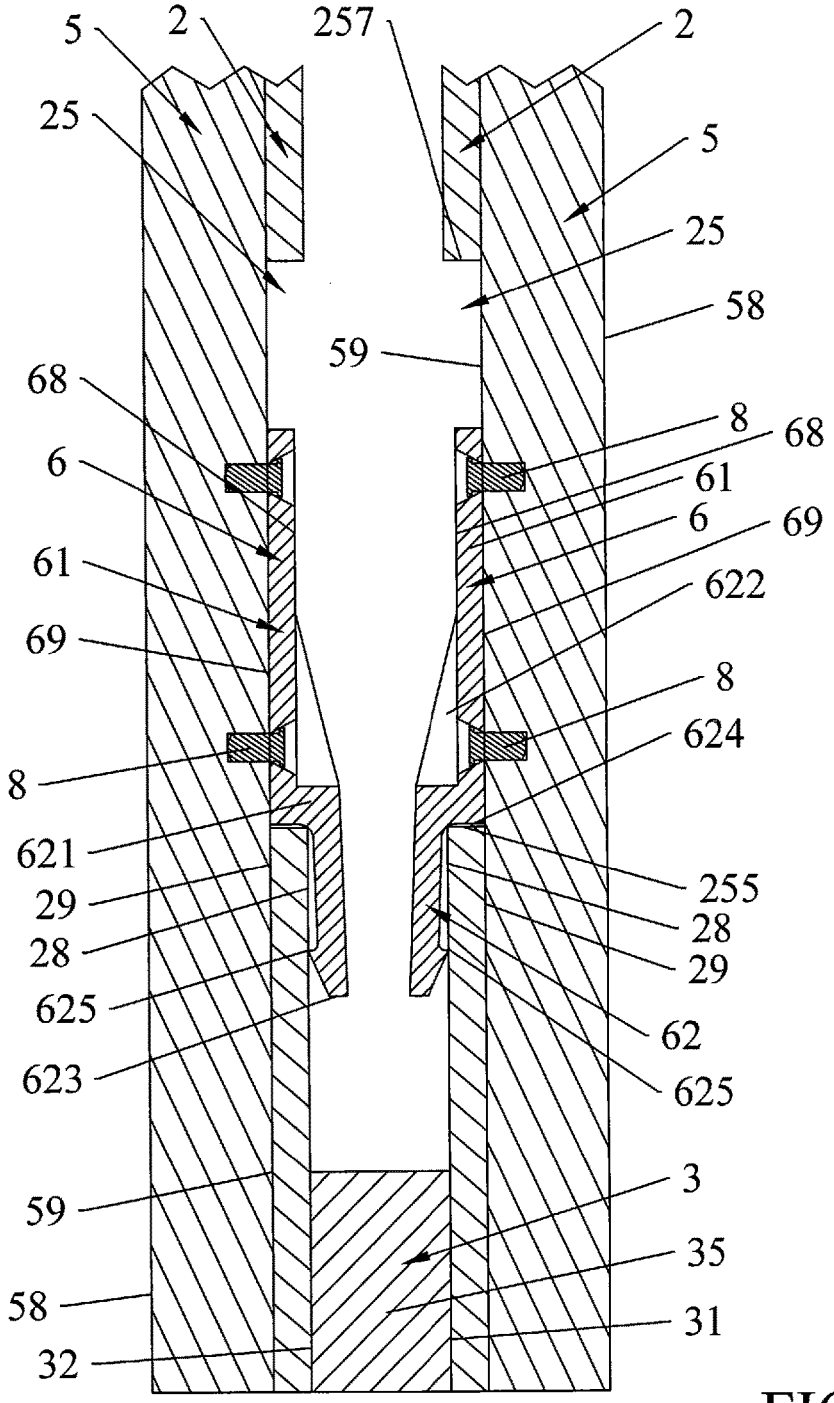
FIG. 13 shows a section according to the line XIII-XIII in FIG. 12.

The first portion 61 can be integrally and firmly mounted with the hidden side 59 of tile 5, while the second portion 62 is tongue-shaped and adapted to be engaged with sheet layer 2 while passing through one of the through slots 25 of sheet layer 2, as shown in FIG. 13.

With particular reference to FIGS. 5-8, the first portion 61 of the fixing mean is parallelepiped-shaped and comprises a hidden flat side 69 which is adapted to remain in complete contact with the hidden side 59 of tile 5. On the opposite side, the first portion 61 comprises a visible flat side 68. The first portion 61 comprises two through holes 60 adapted to be traversed by the screws 8 or nails 8 or other securing means 8 between the visible side 68 and the hidden side 69 to integrally and firmly mount the fixing mean 6 to the hidden side 59 of tile 5, as shown in FIG. 13.

Alternatively, the hidden side 69 of the first portion 61 of the fixing mean 6 is expected to be glued with the hidden side 59 of tile 5.

Figures 5, 6, 7, 8:
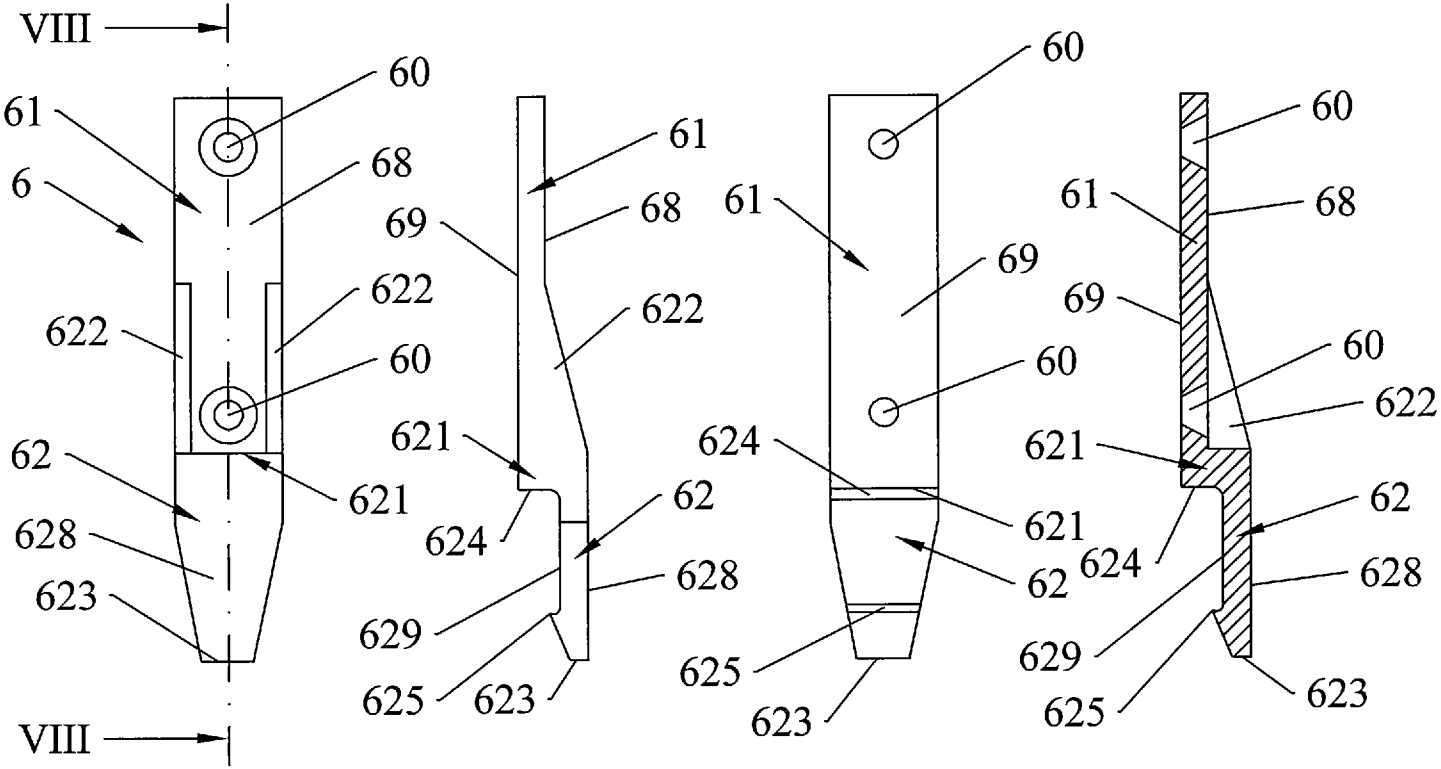
FIG. 5 shows a front view of a fixing mean.
FIG. 6 shows a side view of the fixing mean.
FIG. 7 shows a rear view of the fixing mean.
FIG. 8 shows a section according to the line VIII-VIII in FIG. 5.

As particularly shown in FIGS. 6, 8, the second portion 62 of the fixing mean 6 is joined to the first portion 61 by means of a step-shaped portion 621 of the second portion 62. Said step-shaped portion 621 has a length of a lower side 624 which corresponds to a length of a thickness of sheet layer 2, as shown in FIG. 13.

With particular reference to FIG. 8, the second portion 62 comprises a back side 629 facing sheet layer 2 and a frontal side 628 facing opposite thereto. The second portion 62 comprises a hook-shaped tooth 625 which rises from the back side 629 and is disposed toward an end 623 of the second portion 62. Said hook-shaped tooth 625 of the second portion 62 is a contact of the second portion 62 with the back side 29 of sheet layer 2. The back side 629 of the second portion 62 is parallel to the hidden side 69 of the first portion 61, but the length of the lower side 624 of the step-shaped portion 621 of the second portion 62 creates a height difference between the back side 629 of the second portion 62 and the hidden side 69 of the first portion 61.

Two counterforts 622 in the shape of a right triangle are provided between the first 61 and the second 62 portions. A smaller base of counterfort 622 is in contact with an upper side of the step-shaped portion 621 of the second portion 62, while a larger base of counterfort 622 is in contact with the visible side 68 of the first portion 61. Advantageously, said counterfort 622 is an elastic return element and opposes an elastic force exerted between the hook-shaped tooth 625 and one of the sides 28, 29 of sheet layer 2 once the fixing mean 6 is in the engagement position with sheet layer 2. Said counterfort 622 is advantageously useful for preventing breaks in the second portion 62 from the first portion 61. An oblique side of counterfort 622 is advantageously useful for acting as a guide for facilitating the passage of the fixing mean 6 through the through slot 25 of sheet layer 2.

The fixing mean 6 is adapted to pass from a disengagement position with sheet layer 2 to the engagement position with sheet layer 2.

In order for the fixing mean 6 to pass from the disengagement position to the engagement position, the fixing mean 6 is adapted to cause at least said second portion 62 to pass in horizontal direction through the through slot 25 and to cause it to slide downward in vertical direction along the vertical axis L until the lower side 624 of the step-shaped portion 621 of the fixing mean 6 is in contact with the lower horizontal side 255 of the through slot 25 of sheet layer 2. The lower side 624 of the step-shaped portion 621 rests on the lower horizontal side 255 of said through slot 25.

As shown in FIG. 13, in the engagement position, the fixing mean 6 has the lower side 624 of the step-shaped portion 621 of the second portion. 62 in contact with the lower horizontal side 255 of the through slot 25 of sheet layer 2. The hook-shaped tooth 625 is in contact with the back side 29 of sheet layer 2 where the fixing mean 6 is engaged. The hook-shaped tooth 625 exerts an elastic force on the second portion 62 of the fixing mean 6, said elastic force being balanced by the elastic force of the counterforts 622. By exerting said elastic force on the second portion 62, said hook-shaped tooth 625 is adapted to engage tile 5 more integrally with sheet layer 2 by means of said fixing mean 6. Said hook-shaped tooth 625 bends the second portion 62 so as to increase the elastic force of the second portion 62 on the back side 29 of sheet layer 2. At least one counterfort 622 advantageously avoids the second portion 62 from breaking by folding backwards in a direction opposite to the back side 29 of sheet layer 2, indeed counterfort 622 balances the elastic forces involved.

In said engagement position of the fixing mean 6, the hidden side 59 of tile 5 is in contact with the frontal side 28 of sheet layer 2, as shown in FIG. 13, thus causing tile 5 to be in a mounting position with the sheet layer 2 of the module 1 of the prefabricated wall 100.

Four fixing means 6 for each tile 5 advantageously mount said tile 5 with the sheet layer 2 of the module 1 of the prefabricated wall 100.

Module 1 may mount at least one tile 5 comprising at least one through opening 50 having dimensions comparable with the rectangular through opening 22 of sheet layer 2. The through opening 50 may mount a glass to be applied to the hidden side 59 of tile 5 at the through opening 50 so as not to allow the passage of objects through module 1.

As shown in FIGS. 1-3, 11, 14-19, a diaphragm 7 may be mounted behind said glass, directly on sheet layer 2, to allow the passage of light and to see through module 1.

Figure 17:
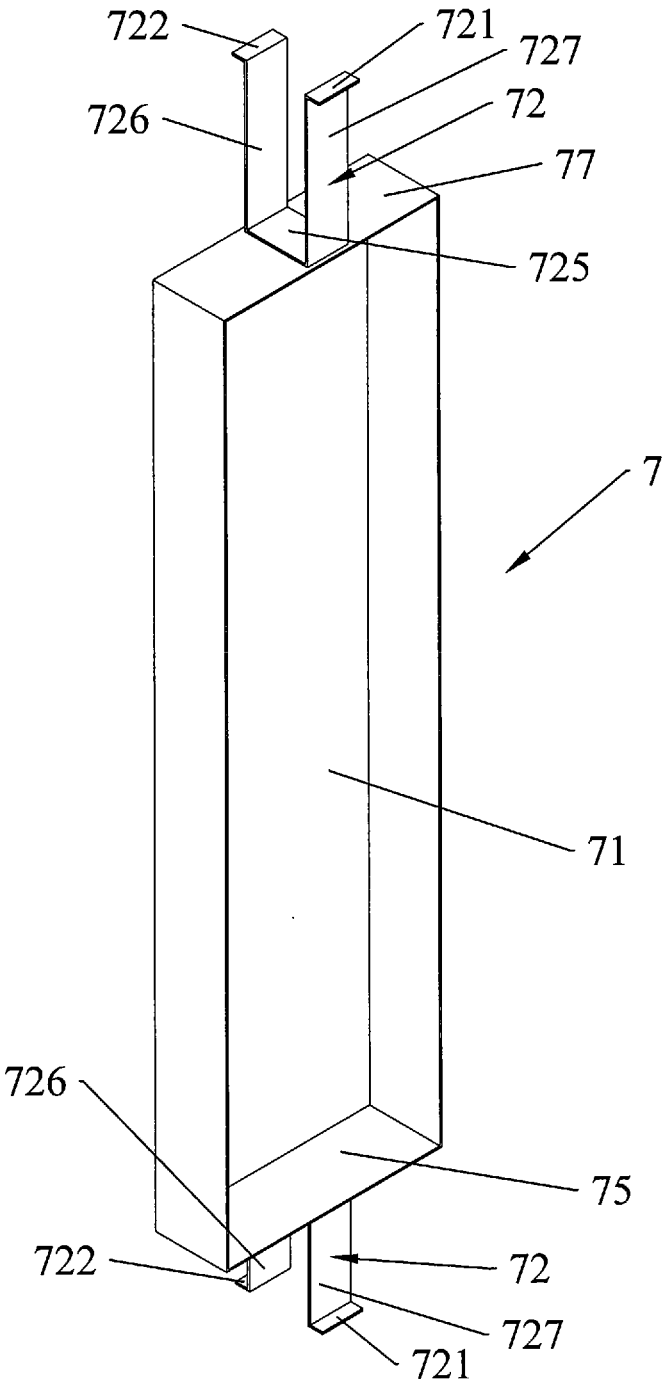
FIG. 17 shows a perspective view of a diaphragm.
Figure 19:
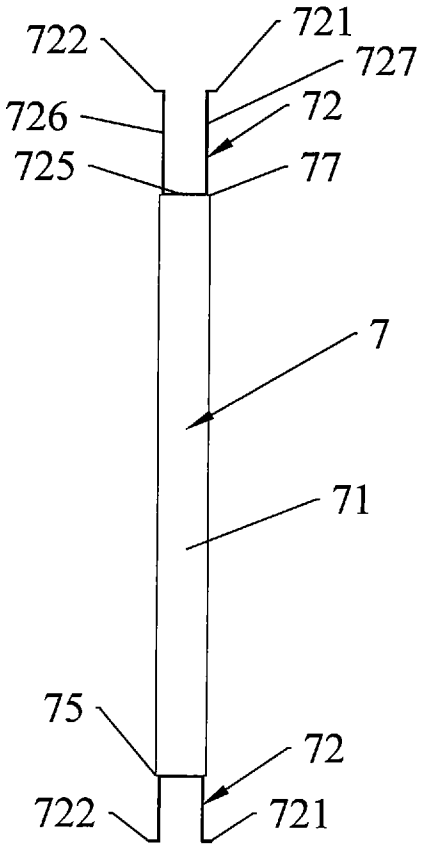
FIG. 19 shows a side view of the diaphragm.
Figure 18:
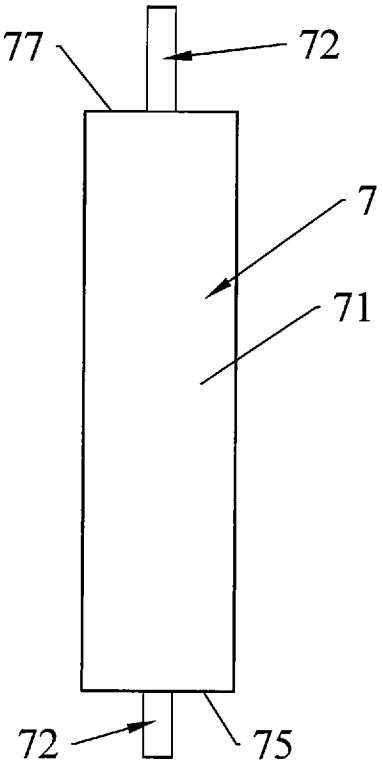
FIG. 18 shows a front view of the diaphragm.

Considering in particular FIGS. 17-19, said diaphragm 7 comprises a main parallelepiped-shaped body 71 preferably made of reflective or transparent or semi-transparent material to allow the passage of light or to see therethrough. Said main body 71 has dimensions corresponding to those of the through opening 50 of tile 5 in order to match completely with the edges of the through opening 50 and to make the structure of module 1 solid.

Figure 16:
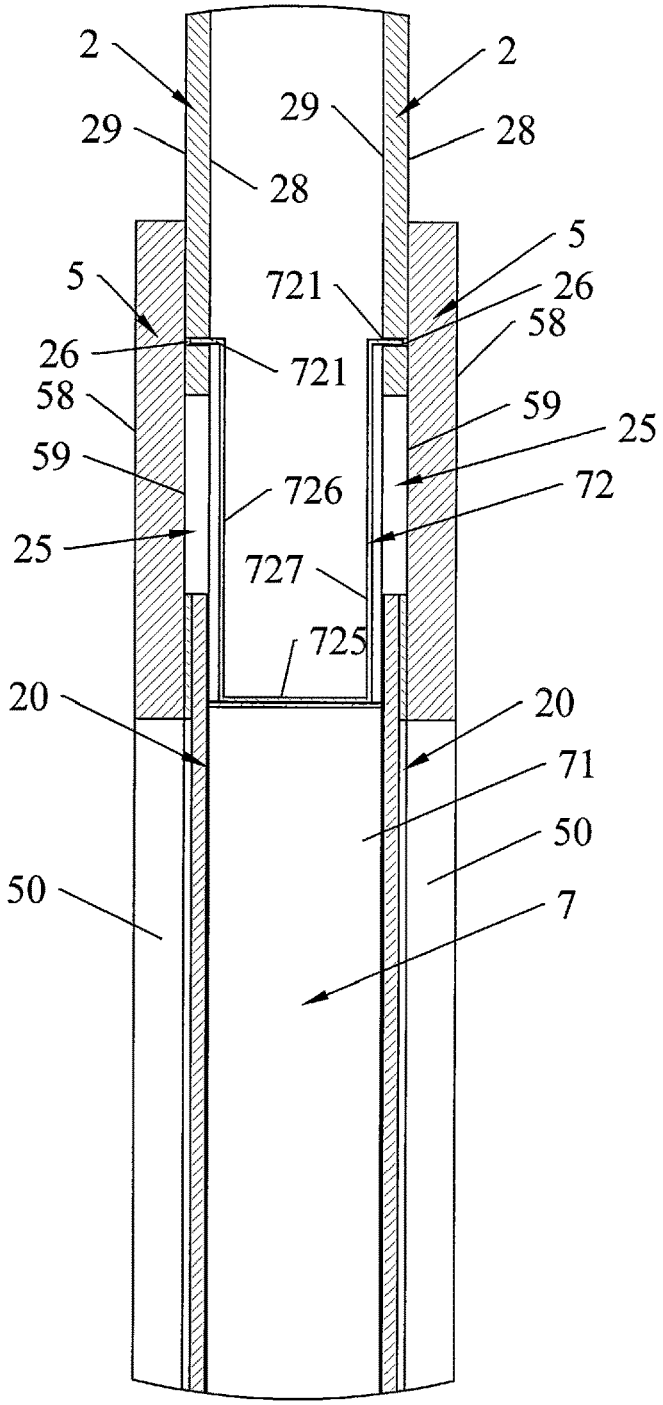
FIG. 16 shows an enlargement D of FIG. 15.

As particularly shown in FIG. 16, a lower base 75 and an upper base 77 of said main body 71 mount extensions 72. Said extensions 72 comprise a rectangular flat base 725. Two vertical walls 726, 727 extend upward at two opposite ends of said flat base 725. A horizontal wall 721 facing the sheet layer 2 mounted frontally with the supporting frame 3 and a horizontal wall 722 facing the second sheet layer 2 mounted at the back with the supporting frame 3 extend outward in horizontal direction at an end of both said two vertical walls 726, 727. Said horizontal walls 721, 722 act as a hook and penetrate smaller slots 26 provided in sheet layer 2 to mount said diaphragm 7 with sheet layer 2 firmly.

Figure 14:
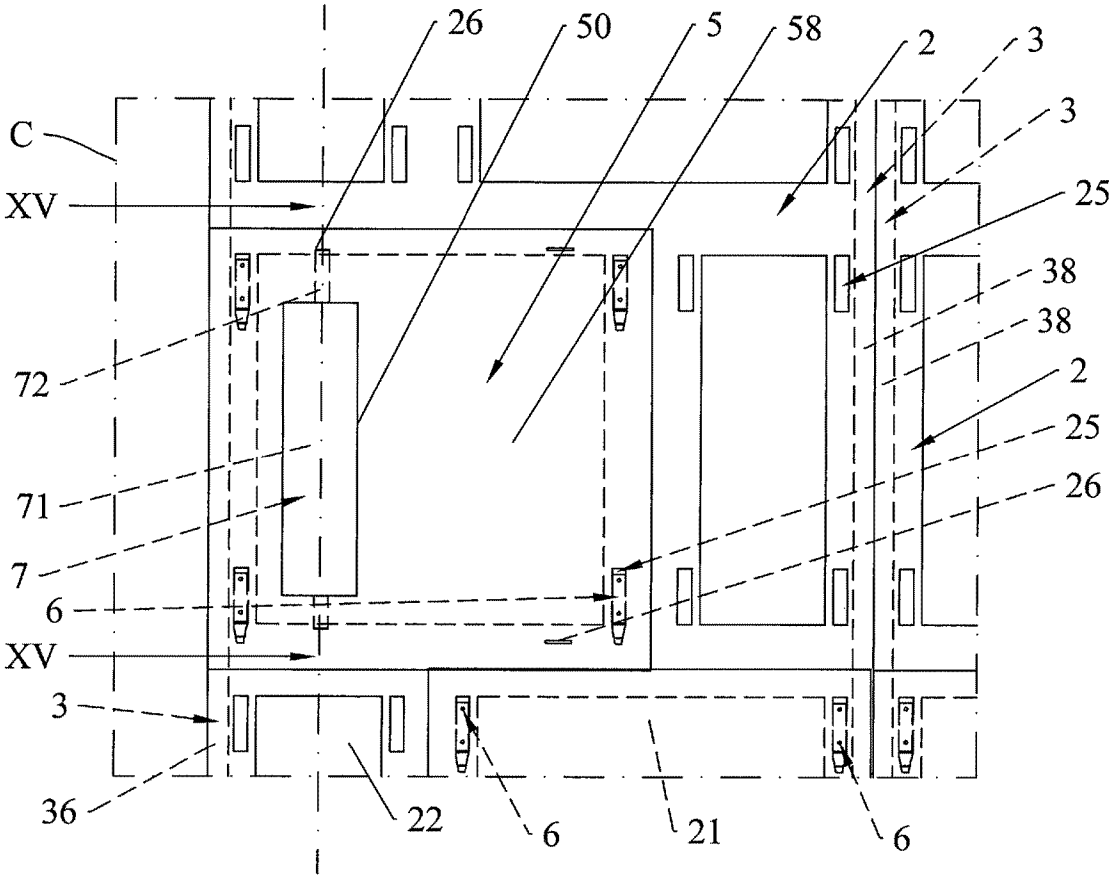
FIG. 14 shows an enlargement C of FIG. 11.
Figure 15:
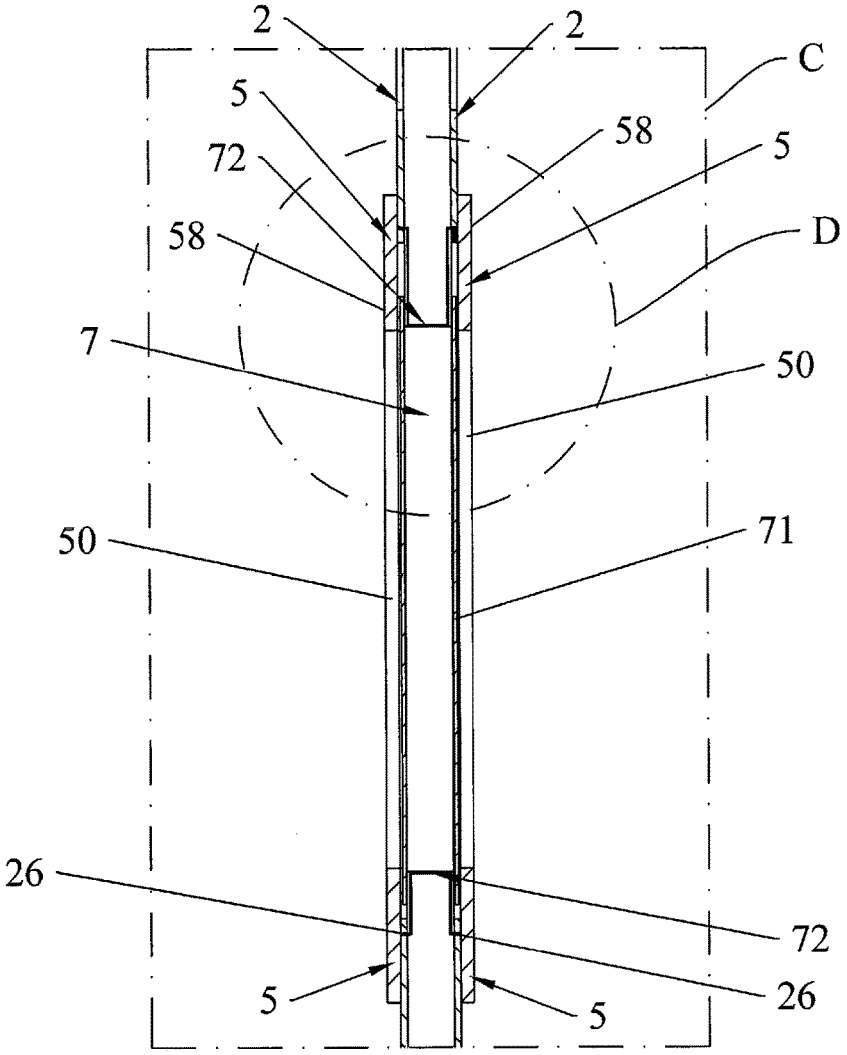
FIG. 15 shows a section according to the line XV-XV in FIG. 14.

As shown in FIG. 14, said smaller slots 26 are a multiplicity of smaller slots 26 disposed around the through openings 20 of sheet layer 2 so as to mount said diaphragms 7 both in horizontal direction and in vertical direction, as shown in FIG. 11. The diaphragms 7 advantageously allow the light to pass and to see through module 1, while making module 1 solid and rigid.

As for the operation of mounting the module 1 of the prefabricated wall 100, at least one of said frames 2 is mounted on the supporting frame 3, as shown in FIG. 9. The tiles 5 are mounted with said sheet layer 2 by means of fixing means 6 by causing them to pass from the disengagement position to the engagement position with sheet layer 2, as shown in FIG. 13, so that the tiles 5 are in the engagement position.

As for the operation of mounting the tiles 5 with through opening 50, diaphragm 7 is mounted with the smaller slots 26 of sheet layer 2 at the through opening 50 of tile 5. Tile 5 is mounted by causing it to pass from the disengagement position to the engagement position with the sheet layer 2 of module 1.

A multiplicity of modules 1 may be mounted on any side of any one of the modules 1, thus allowing a prefabricated wall 100 to be constructed extending as desired along different directions on a geometrical plane on which a starting module 1 lies.

Figure 20:
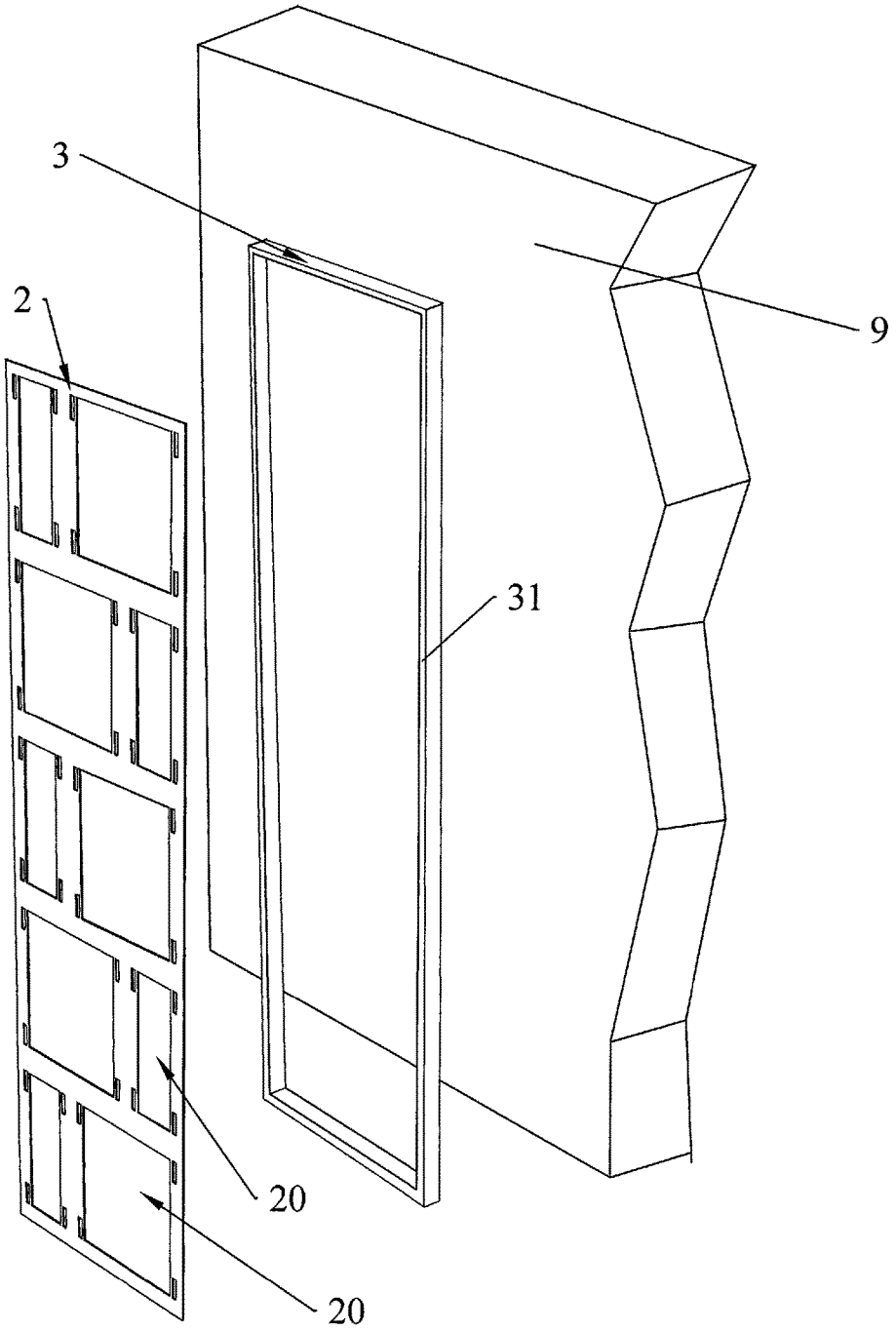
FIG. 20 shows a perspective view of an exploded view of an alternative prefabricated wall module mounted on a wall.
Figure 21:
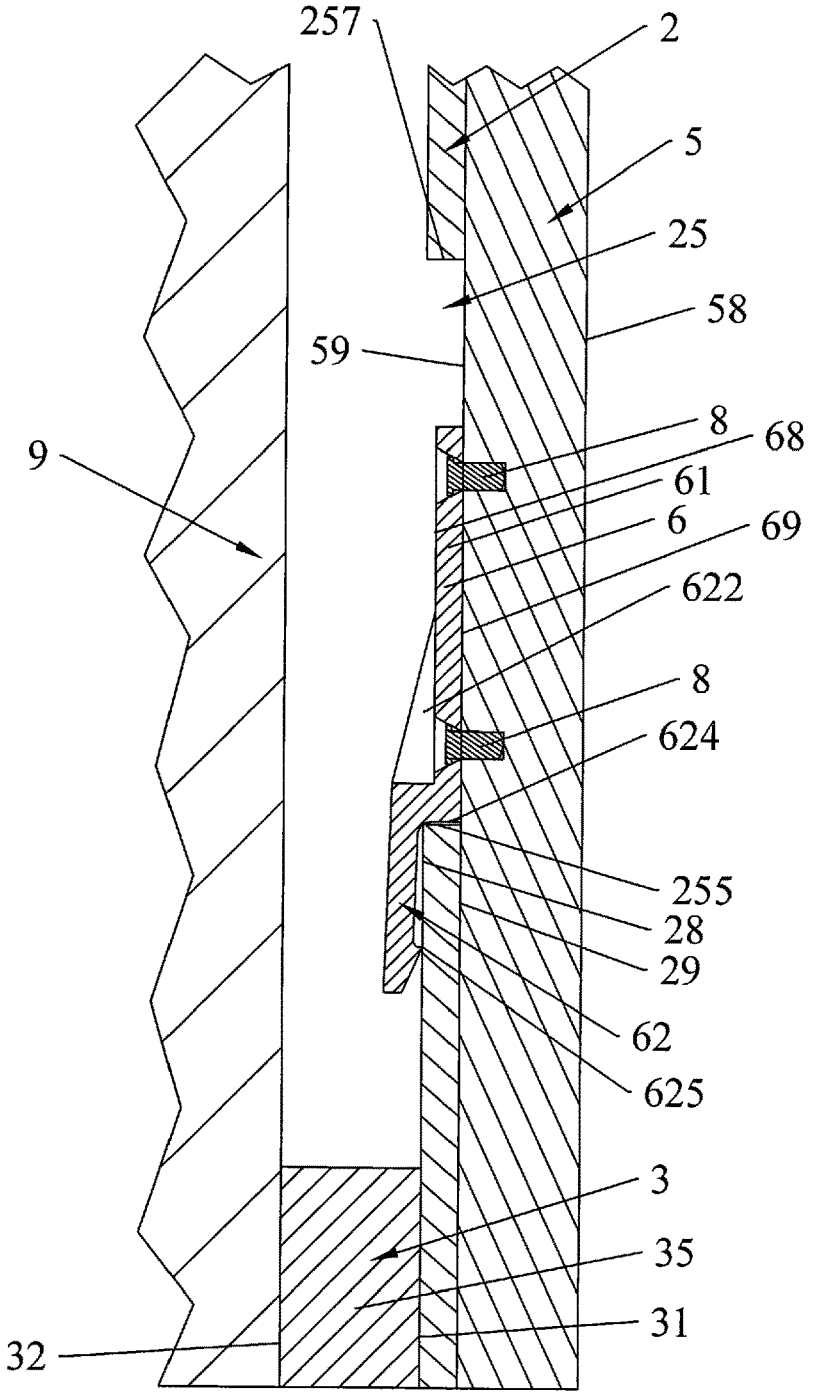
FIG. 21 shows a section according to the line XIII-XIII in FIG. 12 of the alternative prefabricated wall module mounted on a wall.
Figure 22:
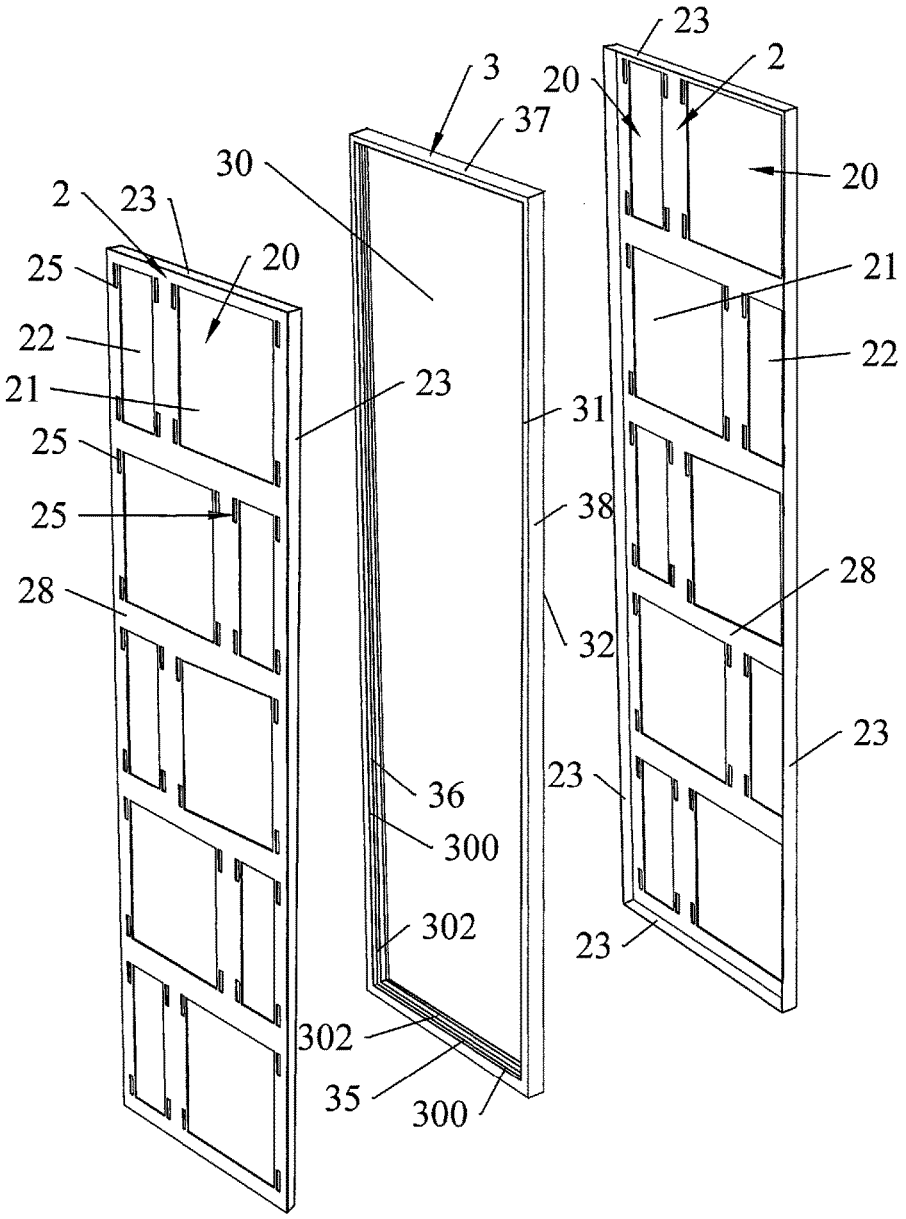
FIG. 22 shows a perspective view of an exploded view of the prefabricated wall module according to a second embodiment of the present invention.
Figure 23:
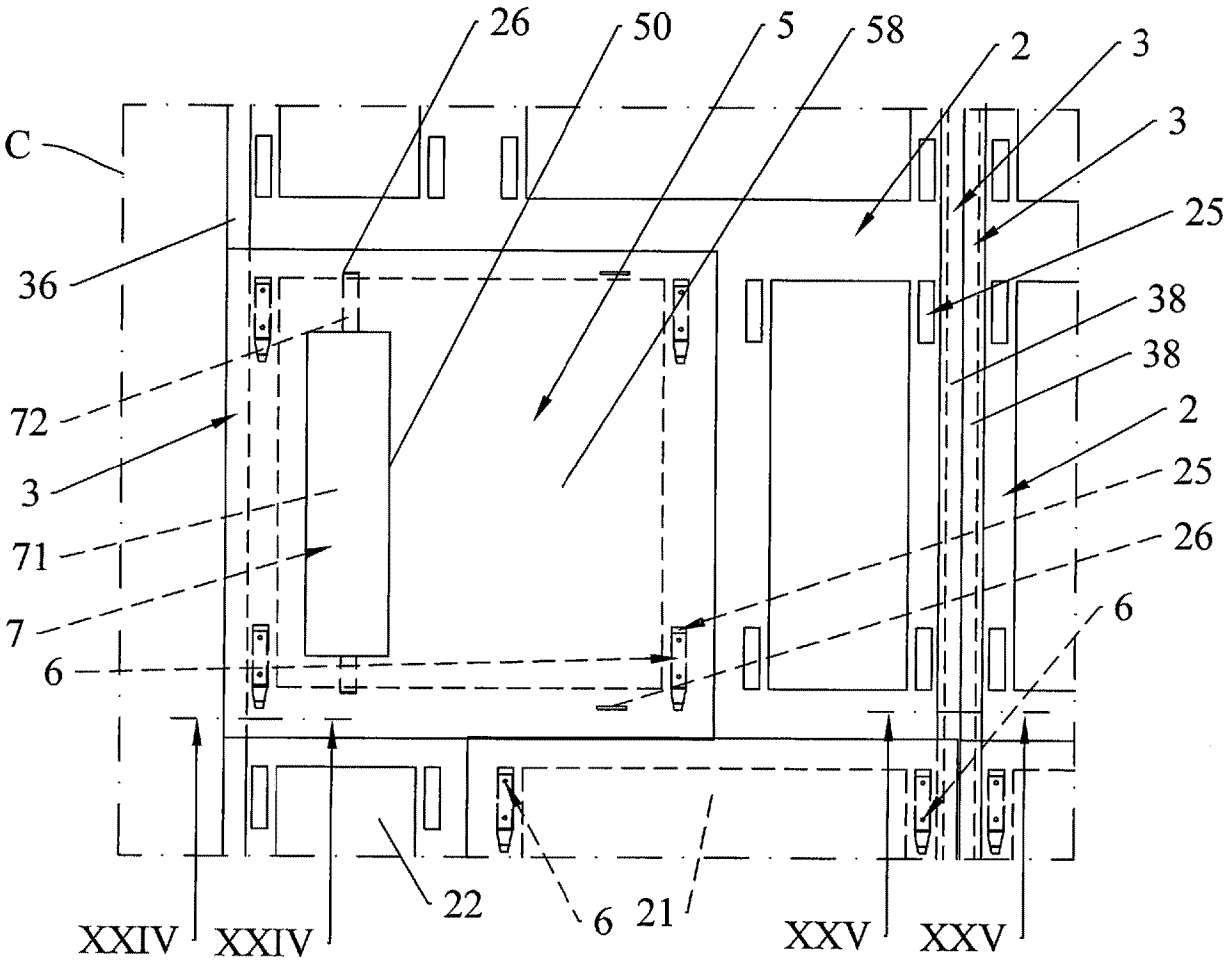
FIG. 23 shows the enlargement C of the second embodiment.

An alternative is shown in FIGS. 20-21, where the module 1 of the prefabricated wall 100 comprises the supporting frame 3 and a single sheet layer 2 mounted on the frontal side 31 of the supporting frame 3. The supporting frame 3 is then mounted on a wall 9 so that the back side 32 of the supporting frame 3 is completely matching with a side wall 9. In said alternative, diaphragm 7 is mounted only in the smaller slots 26 of the sheet layer 2 of module 1.

Alternatively, light sources may be included inside diaphragm 7 for illuminating the environment and for making the prefabricated wall 100 bright.

Yet a further alternative allows module 1 to be mounted on another module 1 so that there is a sequence of sheet layer 2, supporting frame 3, sheet layer 2, supporting frame 3, sheet layer 2, etc. to create as many prefabricated walls 100 as desired.

In yet a further alternative, plates 5, or more generally panels 5, may be mounted in place of the tiles 5.

Again alternatively, the fixing means 6 are provided to have a different nature from those described in the embodiments above, the through slots 25 have a shape and size adapted to be traversed by said fixing means 6 and to allow a second portion 62 of the fixing means 6 to pass by force of gravity to the engagement position with said sheet layer 2.

A further alternative provides for said at least one sheet layer 2 and said supporting frame 3 to be a single piece.

Figure 24:
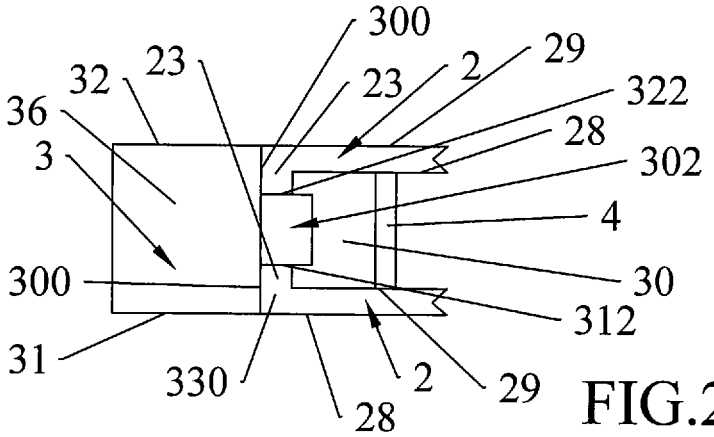
FIG. 24 shows a section according to the line XXIV-XXIV in FIG. 23.
Figure 25:
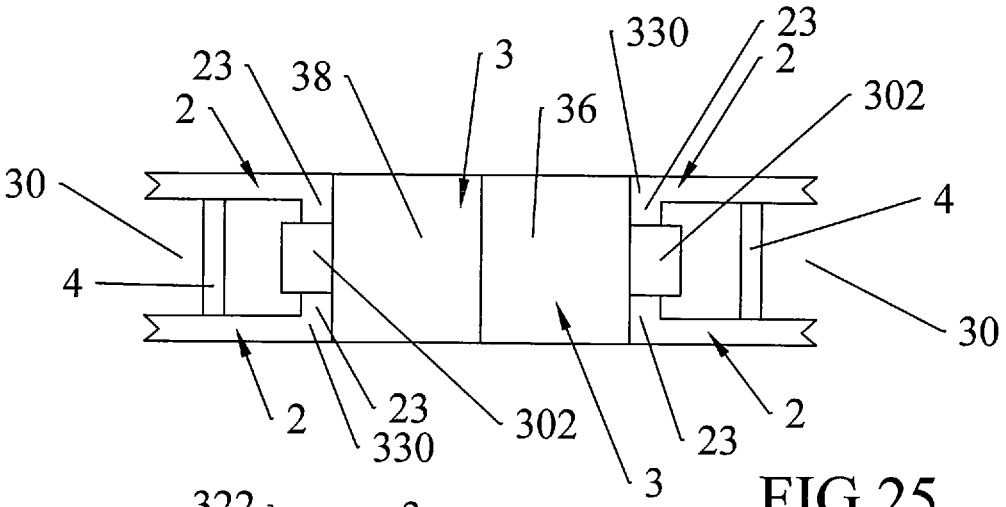
FIG. 25 shows a section according to the line XXV-XXV in FIG. 23.

A second alternative embodiment of the present invention provides for the supporting frame 3 to comprise four bars 35-38, which can be separately mounted to one another. Each of said four bars is parallelepiped-shaped and has a T-shaped section, as shown in FIGS. 24 and 25. Said T-shaped section of any of the four bars 35-38 consists of at least one parallelepiped-shaped extension 302. Said extension 302 of bar 35-38 is disposed perpendicular with respect to bar 35-38 and forms a 90° angle $\alpha$.

According to the second alternative embodiment, said four bars 35-38 delimit the through opening 30 having the same width as the supporting frame 3. Said through opening 30 is just one for each module 1 so as to allow the supporting frame 3 not to limit the passage of light and make module 1 lightweight advantageously.

The frontal side 31 and the back side 32 of the supporting frame 3 are the frontal side 31 and the back side 32 of the bars 35-38 of the supporting frame 3.

The extension 302 of the bars 35-38 faces toward the inside of the through opening 30.

The extension 302 of the bars 35-38 comprises a frontal side 312 and a back side 322. The frontal side 312 of extension 302 faces in the same frontal direction as the frontal side 31 of the bars 35-38 and is parallel thereto 31. The back side 322 of extension 302 faces in the same back direction as the back side 32 of the bars 35-38 and is parallel thereto 32.

Figure 26:
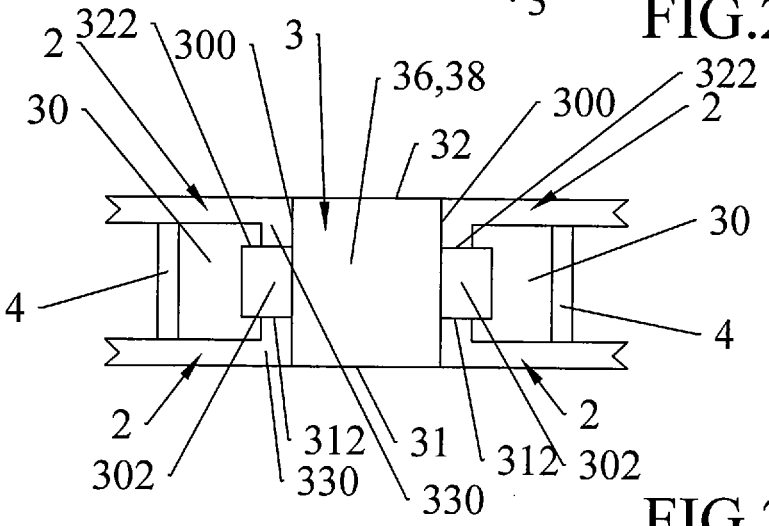
FIG. 26 shows an alternative bar of FIG. 25.

The bars 35-38 comprise an inner side 300 facing the inside of opening 30. The inner side 300 of the bars 35-38 is perpendicular to the frontal sides 31, 312 and to the back sides 32, 322. The inner side 300 is at said 90° angle $\alpha$ with respect to the frontal sides 31, 312 and to the back sides 32, 322, as shown in FIGS. 24-26.

The frontal side 31 and the back side 32 can be seen from the outside when looking in frontal direction and in back direction with respect to the prefabricated wall 100.

The inner side 300 and the sides 312, 322 of the protrusion 302 of the bars 35-38 form the recesses 330 where sheet layer 2 may be mounted.

Sheet layer 2 is mounted in recess 330 through securing means such as glue, screws, nails, plugs or locks, for example.

The frontal side 312 of protrusion 302 and the inner side 300 of the bars 35-38 of the supporting frame 3 mount said sheet layer 2.

The back side 322 of protrusion 302 and the inner side 300 of the bars 35-38 of the supporting frame 3 mount another sheet layer 2.

Alternatively, two adjacent bars, such as bar 36 and bar 38 for example, may be in one piece, as shown in FIG. 26. In said alternative, the adjacent bars 35-38 have a cross-shaped section. Two adjacent bars 35-38 of two different modules 1 are in one piece and form a resulting bar 35-38 which comprises two extensions 302 so that said resulting bar 35-38 has a cross-shaped section. Said two extensions 302 are a first extension 302 facing the through opening 30 of the first module 1 and a second extension 302 facing the through opening 30 of the second module 1, adjacent to the first module 1.

Sheet layer 2 is a plate sheet of the same size and shape as the supporting frame 3 with which it is mounted. Sheet layer 2 is mounted in the recesses 330 of the supporting frame 3. As particularly shown in FIGS. 24-26, the back side 29 of sheet layer 2 is mounted with the frontal side 312 of protrusion 302 and with the inner side 300 of the bar 35-38 of the supporting frame 3.

As shown in FIGS. 23-26, the two sheet layers 2 are mounted with the supporting frame 3 so that the through openings 20 of the sheet layer 2 mounted at the front correspond to the through openings 20 of the sheet layer 2 mounted at the back, so that light can pass through module 1 and said module 1 can be seen through.

The sides of sheet layer 2 comprise protrusions 23 perpendicular to the frontal side 28 and to the back side 29 of sheet layer 2. Said protrusions 23 face the supporting frame 3, that is in the direction of the back side 29 of sheet layer 2 mounted at the front, as shown in FIGS. 23-26. Said at least one sheet layer 2 comprises sides from which protrusions 23 extend facing the supporting frame 3, said protrusions 23 are mounted with the recesses 330 of the supporting frame 3.

The protrusions 23 are mounted with the recesses 330 of the supporting frame 3. The protrusion 23 and the side 28, 29 of sheet layer 2 have an L section, as shown in FIGS. 24-26.

Said protrusions 23 of sheet layer 2 advantageously allow the structure of sheet layer 2 to be reinforced, thus avoiding it from bending. The protrusions 23 facilitate the operation of mounting the self-supporting prefabricated wall 100, since the frames 2 are mounted inside the recesses 330 of the supporting frame 3 and then they are fixed.

Said protrusions 302 of the bars 35-38 advantageously allow sheet layer 2 to be mounted more quickly, which sheet layer 2 is inserted into the recesses 330 consisting of said protrusions 302 and of the inner sides 300 of the bars 35-38 of the supporting frame 3, thus even more advantageously allowing the prefabricated wall 100 to be made self-supporting even during the mounting step, since the protrusions 23 resting in the recesses 330 of the bars 35-38 also support sheet layer 2 before being fixed to the supporting frame 3 in an integral and lasting manner.

Spacers 4 may be mounted between two sheet layers 2, as shown in FIGS. 24-26. Said spacers 4 are perpendicular to the sides 28-29 of the frames 2 and advantageously reinforce the structure of the prefabricated wall 100. Spacer 4 has a shape chosen from a list comprising parallelepipeds and cylinders. Spacer 4 is mounted between the two sheet layers 2 mounted with the supporting frame 3. Spacer 4 is mounted inside opening 30 and integrally connects the two sheet layers 2 which are mounted on the supporting frame 3 of the prefabricated wall 100.

Figure 27:
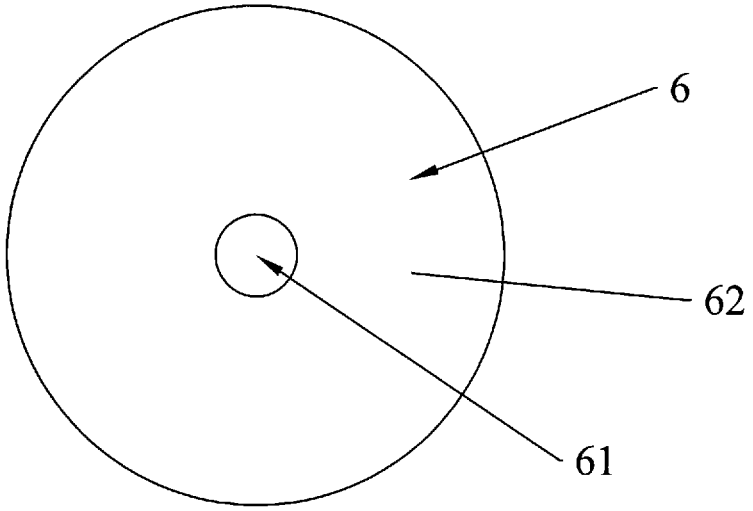
FIG. 27 shows a front view of an alternative fixing mean.
Figure 28:
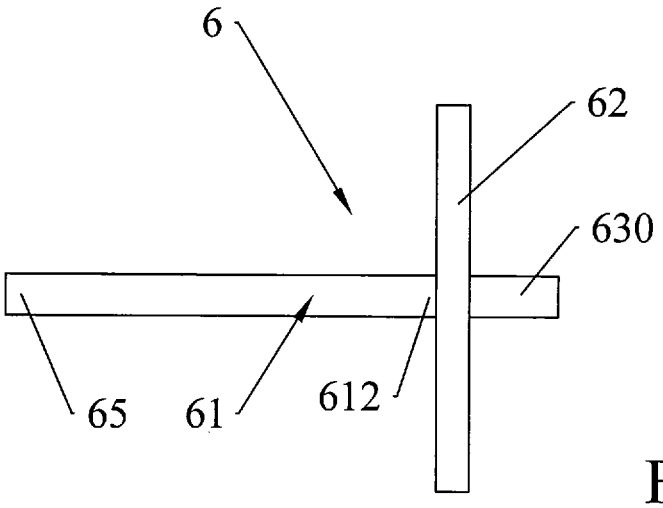
FIG. 28 shows a side view of the alternative fixing mean.
Figure 29:
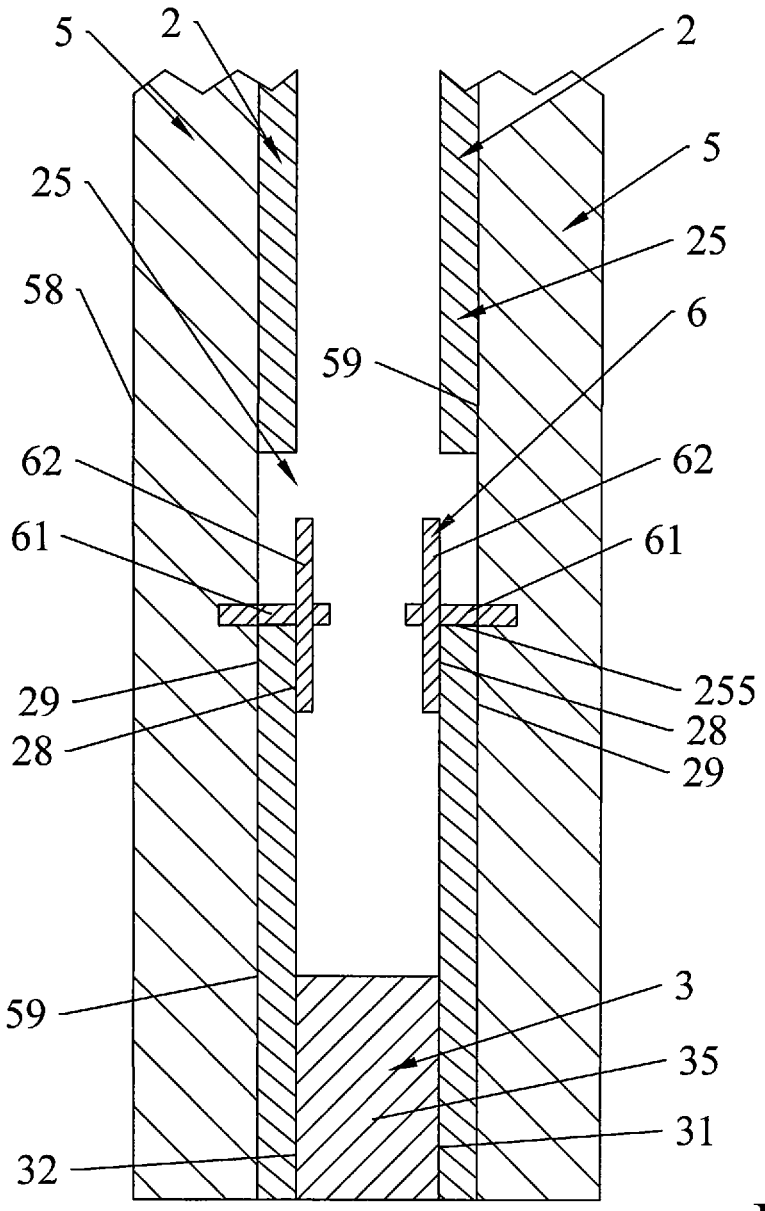
FIG. 29 shows a section according to the line XIII-XIII in FIG. 12 of the second embodiment of the prefabricated wall according to the present invention.

As shown in FIGS. 27-29, a further alternative is provided, according to which the tiles 5 are mounted on sheet layer 2 by means of alternative fixing means 6 comprising a first portion 61 and a second portion 62. The first portion 61 is cylindrical in shape and comprises an engagement portion 65 at one end, which mounts tile 5, and an end portion 612 at the other end, which mounts the second portion 62. The first portion faces in axis the inside of the opening 30 of the supporting frame 3 of the prefabricated wall 100.

The engagement between the inner side 59 of tile 5 and the engagement portion 65 of the first portion 61 of the alternative fixing mean 6 occurs by means of a hole on the inner side 59 of tile 5. Alternatively, the engagement portion 65 may be screwed into the hole of the inner side 59 of tile 5.

The second portion 62 is disc-shaped and is engaged with the end portion 612 of the first portion 61. The end portion 612 of the first portion 61 is engaged in a geometric center of the geometric disc of the second portion 62 of the alternative fixing mean 6.

The first portion 61 of the alternative fixing mean 6 can be integrally and firmly mounted with the hidden side 59 of tile 5, while the second portion 62 is disc-shaped and is adapted to be engaged with sheet layer 2 by passing through one of the through slots 25 of sheet layer 2, as shown in FIG. 29.

Figure 30:
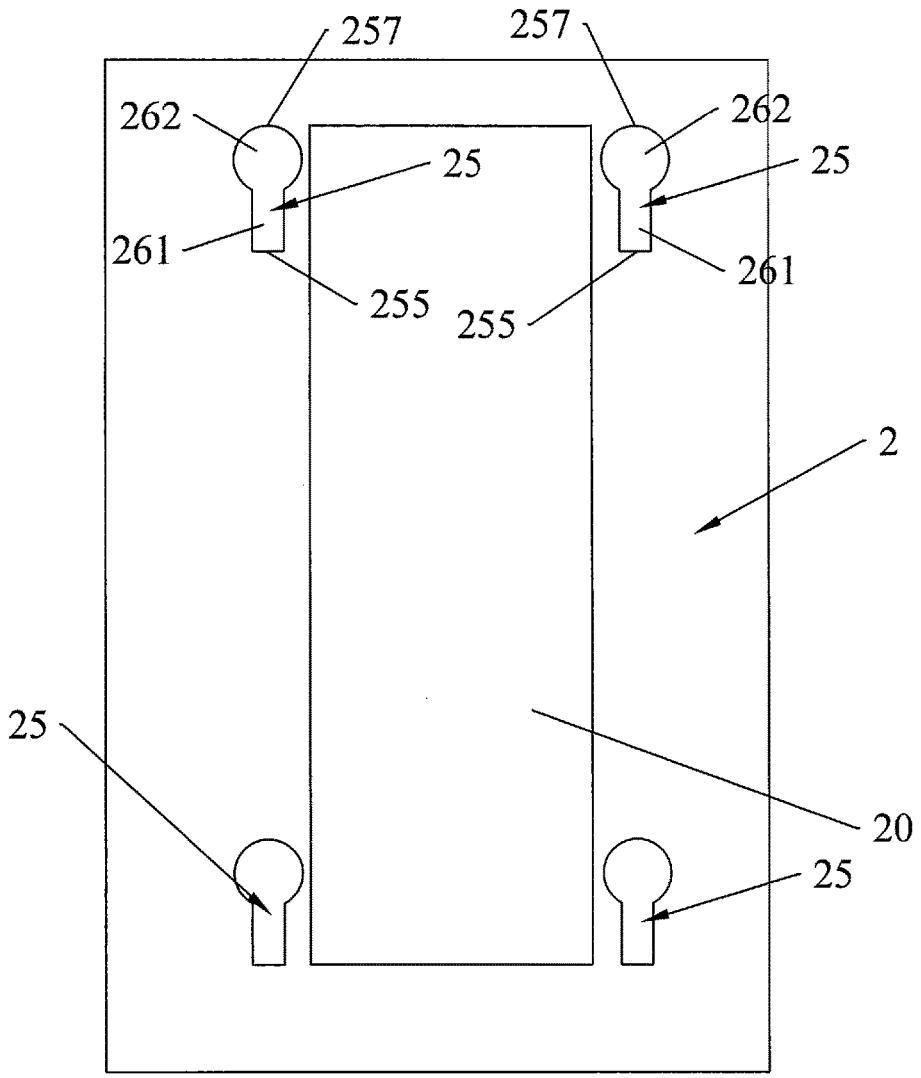
FIG. 30 shows an alternative slot of the sheet layer for mounting the alternative fixing mean.

As shown in FIGS. 29 and 30, in order to mount said alternative fixing means 6, said through slots 25 of sheet layer 2 comprise an upper portion 262 of dimensions adapted to pass through said second disc-shaped portion 62 of the alternative fixing mean 6 and a lower portion 261 of the through slot 25 of dimensions adapted to engage the first portion 61 of the alternative fixing mean 6. The second portion 62 passes through the upper portion 262 of the through slot 25 of sheet layer 2 and then said fixing mean 6 falls by gravity downward until the first portion 61 engages the lower portion 261 of the through slot 25 up to causing it 61 to rest on a lower horizontal side 255 of said through slot 25.

The slots 25 are disposed around the through openings 20 of the frame as in the first embodiment described above, so as to allow quick mounting with minimized gaps.

In order for the fixing mean 6 to pass from the disengagement position to the engagement position, the fixing mean 6 is adapted to cause at least 25 said second portion 62 to pass in horizontal direction through the through slot 25 and to cause it to slide downward in vertical direction along the vertical axis L until the first portion 61 of the fixing mean 6 is in contact with the lower horizontal side 255 of the through slot 25 of sheet layer 2, as particularly shown in FIG. 29.

Advantageously, said alternative fixing means 6 allow the operations of mounting the fixing mean 6 with tile 5 to be facilitated, because just a single hole should be made in tile 5. Said alternative fixing means 6 are further advantageous as they do not require to be oriented, since the disc shape of the second portion 62 of the alternative fixing mean 6 allows the fixing mean 6 to be mounted symmetrically, thus further allowing the advantage of being able to rotate tile 5 so as to mount it easily with sheet layer 2 without needing to orient the alternative fixing mean 6 again.

A further alternative provides for the alternative fixing mean 6 to comprise a further extension 630 of the first portion 61 which excessively protrudes into opening 30 so as to promote the mounting operation by an operator advantageously. Said extension 630 can be handled by the operator, who can thus easily screw or mount said alternative fixing mean 6 with tile 5.

Figure 31:
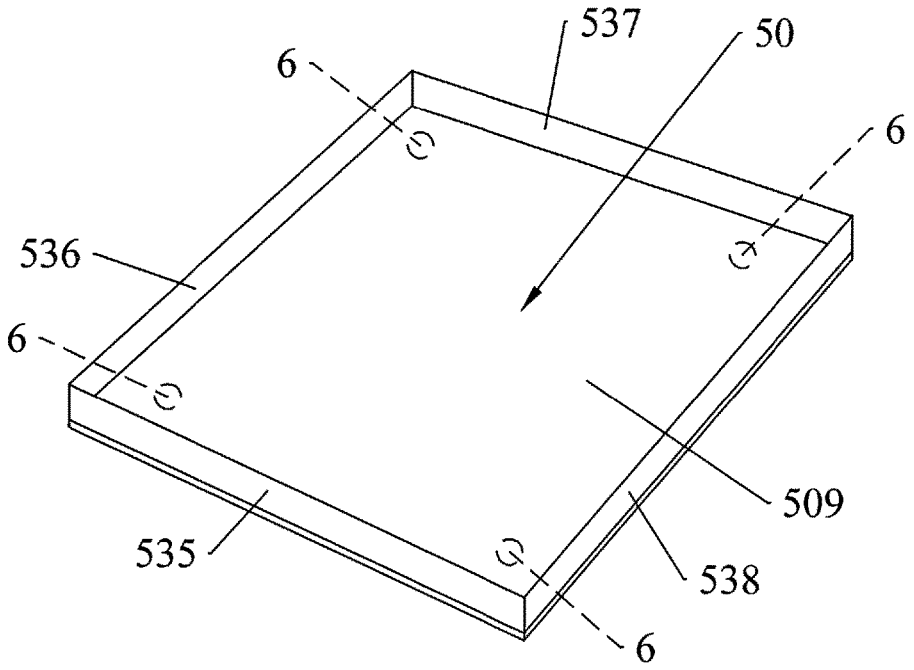
FIG. 31 shows a metal box for mounting a tile for the prefabricated wall.

Yet a further alternative of the present invention provides for the back side 59 of tile 5 to be mounted inside a metal box 50, as shown in FIG. 31. Said metal box 50 comprises a base portion 509 in contact with the back side 59 of tile 5 and at least two walls 535-538 of the metal box 50 which extend in a direction perpendicular to the base portion 509 so as to enclose the sides of tile 5. The at least two walls 535-538 of the metal box 50 have a smaller height than the thickness of tile 5. The fixing mean 6 in said further alternative is directly mounted with the metal box 50 without making a hole in tile 5, thus advantageously allowing tile 5 to be mounted on sheet layer 2 so as to reduce the side gaps between one tile 5 and the next 5 more easily. The hole on the metal box 50 allows higher perforation speed and facility, and improved and more accurate mounting and centering of the tiles 5 on sheet layer 2, thus advantageously reducing the side gaps between the tiles 5 to be from 0.5 to 5 millimeters, i.e. minimized.

Said prefabricated wall 100 may advantageously be mounted both inside and outside buildings.

The prefabricated wall 100 is advantageously self-supporting due to the supporting frame 3 and is adapted to remain standing alone without resting against a wall.

Each tile 5 advantageously mounts at least four fixing means 6 which are inserted into corresponding through slots 25 and are easily and readily engaged with sheet layer 2.

The prefabricated wall 100 may advantageously be made modular in modules 1 with sheet layer 2 having through openings 20 of dimensions adapted to be related to the dimensions of the tiles 5, so that said frames 2 may be completely covered by the tiles 5.

Said modules 1 are advantageously easy and quick to be assembled.

The invention claimed is:

1. A prefabricated modular wall comprising at least one module comprising at least one sheet layer adapted for mounting at least one panel by means of fixing means, wherein each one of said at least one module comprises one supporting frame to support each one of said at least one module, said one supporting frame comprises bars disposed to form one frame delimiting one through opening and each one of said at least one sheet layer is mounted with said one supporting frame, said at least one sheet layer has same dimensions and same shape of said one supporting frame, said at least one sheet layer is a plate sheet comprising a multiplicity of through openings and a multiplicity of through slots, each one through slot of said multiplicity of through slots is adapted for being traversed by a fixing mean of a multiplicity of said fixing means to an engagement position of said fixing mean with said at least one sheet layer to mount said at least one panel, wherein said multiplicity of through openings of said at least one sheet layer comprise square-shaped through openings and rectangular shaped through openings, the square-shaped through openings and the rectangular-shaped through openings having vertical sides of same vertical dimensions, wherein a respective said square-shaped through opening and a respective said rectangular-shaped through opening are located side by side horizontally on a geometrical plane where said at least one sheet layer lies, thereby forming a couple of through openings disposed in ordered horizontal rows of through openings, and said ordered horizontal rows of through openings follow each other along a vertical axis (L), wherein the horizontal rows arranged above each other having couples of through openings disposed into an inverted order.

2. The prefabricated wall according to claim 1, wherein two of said rectangular-shaped through openings side by side horizontally have the same horizontal dimensions of horizontal sides of the square-shaped through openings.

3. The prefabricated wall according to claim 1, wherein said at least one panel comprises at least a through opening and that said module comprises at least one diaphragm comprising a main body being transparent or semi-transparent and at least one extension comprising a horizontal wall adapted for fixing with at least one smaller through slot of a multiplicity of smaller slots of said at least one sheet layer, said main body has dimensions corresponding to that of a through opening of said at least one panel.

4. The prefabricated wall according to the claim 1, wherein said at least one panel is mounted with a metal box and said metal box mounts said fixing means.

5. The prefabricated wall according to claim 1, wherein said supporting frame comprises four bars of parallelepiped shape disposed to form a square frame of the same dimensions of the module, said at least one sheet layer is mounted on at least one side of said supporting frame.

6. The prefabricated wall according to the claim 5, wherein at least one bar of any one of said four bars of the supporting frame comprises an extension facing toward inside of the through opening.

7. The prefabricated wall according to the claim 6, wherein said extension comprises a frontal face and a rear face, said at least one bar comprises an inner face facing toward the inside of the through opening, said inner face is perpendicular to the frontal face and to the rear face forming recesses locations for mounting said at least one sheet layer.

8. The prefabricated wall according to the claim 6, wherein two adjacent bars of two different modules are one piece and form a resulting bar which comprises two extensions as that said resulting bar has a section of cross shape.

9. The prefabricated wall according to the claim 7, wherein said at least one sheet layer comprises sides from which extend protrusions facing toward the supporting frame, said protrusions are mounted with the recesses of the supporting frame.

10. The prefabricated wall according to claim 1, wherein each fixing mean of said multiplicity of fixing means comprising a first portion and a second portion, said first portion of said fixing mean is integrally mounted with said at least one panel and said second portion of said fixing mean is adapted for passing through said through slot to said engagement position of said fixing mean with said at least one sheet layer to mount said at least one panel.

11. The prefabricated wall according to claim 10, wherein said multiplicity of through slots of said at least one sheet layer are disposed around at least one through opening of said multiplicity of through openings of said at least one sheet layer, each through slot of said multiplicity of through slots having sides of dimensions adapted for the insertion of at least said second portion of said fixing mean.

12. The prefabricated wall according to claim 10, wherein that around each of said through openings four through slots are provided and are disposed close to four angles of the through openings, a couple of through slots are disposed close to two upper angles of the through opening so that an upper horizontal side of the through slot is disposed at the same height of an upper horizontal side of the through opening, another couple of through slots are disposed close to two lower angles of the through opening so that the lower horizontal side of the through slot is disposed at the same height of a lower horizontal side of the through opening.

13. The prefabricated wall according to claim 10, wherein said first portion of said fixing mean is mounted with a hidden side of said at least one panel and that said second portion of said fixing mean joins with said first portion by means of a step-shaped portion of the second portion, said step-shaped portion having a length of a lower side corresponding to a length of a thickness of said at least one sheet layer and said length of the lower side make a height difference between a back side of the first portion and a back side of the second portion, said fixing mean is adapted for passing from a disengagement position to the engagement position with said at least one sheet layer, said engagement position of the fixing mean provides that said lower side of the step-shaped portion of the second portion leans on a lower horizontal side of said through slot and that the second portion is into contact with one side of said at least one sheet layer.

14. The prefabricated wall according to claim 13, wherein said second portion of said fixing mean comprises at least one hook-shaped toothy and at least one counterfort said hook-shaped tooth rises from said back side of the second portion and in the engagement position of the fixing mean with said at least one sheet layer said hook-shaped tooth enters into contact with one of said side of said at least one sheet layer and said at least one counterfort is an elastic recall element between the first portion and the second portion of the fixing mean.

15. The prefabricated wall according to claim 10, wherein said first portion of said fixing mean is mounted with a hidden face of said at least one panel and that said second portion of said fixing mean is of disc shape and is engaged with an end portion of the first portion, said end portion of the first portion is engaged at a geometric center of the disc of the second portion of the fixing mean, said first portion of said fixing mean is adapted to pass from a disengagement position to the engagement position with said at least one sheet layer, said engagement position of the fixing mean provides that said end portion of the first portion rests on a lower horizontal side of said through slot and that the second portion passes through said through slot of said at least one sheet layer.

16. The prefabricated wall according to claim 15, wherein said multiplicity of through slots of said at least one sheet layer are disposes around the at least one through opening of said multiplicity of through openings of said at least one sheet layer, each through slot of said multiplicity of through slots comprises an upper portion of dimensions adapted to pass through said second portion of disc shape of the fixing mean and a lower portion of the through slot of dimensions adapted to engage the first portion of the fixing mean up to rest on one lower horizontal side of said through slot.

17. A method of constructing a prefabricated wall according to claim 1, wherein at least one first module and at least one second module of said at least one module are mounted on the same geometrical plane by rotating said at least one second module of an angle of 180° about the vertical axis (L) and by placing side by side a side bar of said supporting frame of said at least one second module with a side bar of said supporting frame of said at least one first module.

* * * * *